US012648630B2

(12) United States Patent
Stepp-Jones

(10) Patent No.: US 12,648,630 B2
(45) Date of Patent: Jun. 9, 2026

(54) AUTOMATED RECIPROCATING HAIR DRYER

(71) Applicant: Shawna Stepp-Jones, Towson, MD (US)

(72) Inventor: Shawna Stepp-Jones, Towson, MD (US)

( * ) Notice: Subject to any disclaimer, the term of this patent is extended or adjusted under 35 U.S.C. 154(b) by 545 days.

(21) Appl. No.: 18/346,960

(22) Filed: Jul. 5, 2023

(65) Prior Publication Data

US 2024/0008619 A1 Jan. 11, 2024

Related U.S. Application Data

(60) Provisional application No. 63/358,339, filed on Jul. 5, 2022.

(51) Int. Cl.

| | |
|---|---|
| ***A45D 20/16*** | (2006.01) |
| ***A45D 20/00*** | (2006.01) |
| ***A45D 20/08*** | (2006.01) |
| ***A45D 20/12*** | (2006.01) |
| ***A45D 20/28*** | (2006.01) |

(52) U.S. Cl.

CPC ..... *A45D 20/16* (2013.01)

(58) Field of Classification Search

CPC ..... A45D 20/16; A45D 20/00; A45D 20/08; A45D 20/122; A45D 2020/126; A45D 20/28

USPC ..... 34/442, 443

See application file for complete search history.

(56) References Cited

U.S. PATENT DOCUMENTS

2012/0131815 A1* 5/2012 Kraus ..... H01L 21/67051 34/239

2019/0142133 A1* 5/2019 Smith ..... F16M 11/40 248/160

* cited by examiner

*Primary Examiner* — Deming Wan

(74) *Attorney, Agent, or Firm* — GIBRALTAR CONSULTING; Tariq Najee-Ullah

(57) ABSTRACT

Disclosed herein is an automated reciprocating hair dryer including a base configured to exhaust air, a bowl having a top opening and a bottom opening, and a pipe connected to the base. The bowl has an outer wall and an inner wall forming a chamber, and a protruding structure forming an inlet opening. A linear actuator includes a support frame having a track and a motor connected to a power source and a positioning sensor. The motor drives the linear actuator to reciprocate the bowl from a raised position to a lower position around the pipe. A hose, a housing, a computing device, and a blower are also included. The blower is connected to the first end of the hose, and the second end of the hose is connected to the inlet opening of the bowl. The pipe is in alignment with the top and bottom openings of the bowl, and the first end of the pipe exhausts the air into the base.

15 Claims, 20 Drawing Sheets

AUTOMATED RECIPROCATING HAIR DRYER

PRIORITY CLAIM

This application is a U.S. Non-Provisional Utility Application entitled, "AUTOMATED RECIPROCATING HAIR DRYER" which claims priority to U.S. Provisional Application No. 63/358,339 filed Jul. 5, 2022 entitled, "SPIN AND AIR DRYER FOR ARTIFICIAL AND VIRGIN HAIR BUNDLES AND WIGS AND METHODS THEREOF" the entirety of which is hereby incorporated by reference as if fully set forth herein.

FIELD OF INVENTION

The Devices and Methods for handling pliant wefts and textile matrices of elongate strands and artificial hair and devices and methods associated with removing moisture from pliant wefts and textile matrices of elongate strands and artificial hair.

BACKGROUND OF THE INVENTION

Hair dryers have been in use for many years and have undergone various improvements to enhance their functionality. When drying removable hair such as, human hair and/or synthetic hair used in wigs and/or hair bundles, traditional hair dryers require the user to manually move the dryer over the wig and/or hair bundle. This can be time-consuming and tiring, especially when drying a wig and/or a hair bundle of long hair. To address this issue, some hair dryers have been designed with a stand that allows the user to place the dryer on a surface and adjust the angle of the dryer to direct the airflow to the desired area. However, these hair dryers still require manual operation and a problem occurs when a wig and/or a hair bundle blows away from the dryer from the force of the air. Further, the heat from current hair dryers in today's market may damage the hair of the wig and/or bundle if a user applies the drying unit to the hair for too long.

Another approach to automated hair drying involves the use of a hooded dryer, which is a large, dome-shaped device that fits over the user's head and blows hot air onto their hair. However, these devices are bulky and not suitable for drying removable hair portions. They are typically found in salons and require professional installation and maintenance. However, none of these approaches have provided a comprehensive solution that combines the features described in this disclosure. The present invention provides an automated reciprocating hair dryer that is compact, affordable, and customizable to provide quick and uniform hair drying of different hair types such as human hair, synthetic hair, wigs, and/or hair bundles.

Another example of a challenge with using traditional dryers when used for drying detachable hair pieces may include: A user will use a towel to hold and suspend the detachable hair pieces directly under the airflow of the traditional overhead dryer while draping both ends of the towel over the overhead drying device. This process is troublesome for the user because as the towel and hair begin to dry, if not secure or being watched, the towel will eventually blow away from the dryer causing the user to repeatedly start the process over.

Accordingly, there remains a need for an improved dryer system and method for hair bundles and wigs. This need and other needs are satisfied by the various aspects of the present disclosure.

SUMMARY OF THE INVENTION

The presently disclosed subject matter: Spin and Air Dryer For Artificial and Virgin Hair Bundles and Wigs.

Generally, the present invention comprises at least embodiments related to devices and methods for drying pliant plies of material and pliant wefts of co-hemmed elongate and/or depending materials or hair having a hem with a directed flow of air and centrifugal force.

Specifically, the present invention comprises embodiments of a device method/device for drying depending strands of artificial hair suitable for use as cosmetic hair extensions.

According to an aspect, a method of drying a pliant elongate ply having a handle end, comprising engaging the handle end of the ply with a hanger; supporting the hanger above a drying chamber with a hanger perch; enclosing the drying chamber within a housing, defining an airflow volume; and rotatably supporting the drying chamber with respect to the housing, such that the ply is supported vertically within the drying chamber and alternately supported at least one of in a path of a flow of drying air and under centrifugal force within the drying chamber.

According to an aspect, a device for drying a pliant elongate ply having a handle end, such as a weft of hair/etc./having a hem, comprising: a hanger configured to engage the weft/hem/handle end; a hanger perch configured to support the hanger above a drying chamber; and a housing defining an airflow volume configured to enclose the drying chamber therein, wherein the drying chamber is rotatably supported within the housing, such that the device is configured to vertically support the weft within the drying chamber and be alternately supported at least one of in a path of a flow of drying air through and under centrifugal force within the drying chamber.

According to an aspect, embodiments comprise ones in which the airflow useful within the airflow volume can be sourced from a variety of directions, such as from any location within the airflow volume, from within the housing in such locations as may be outside the airflow volume, including locations as inside or outside of the drying chamber, or from such apertures above and below the volume, such as, but not limited to a vented lid, annular or side manifold, and/or base.

Additional aspects of the invention will be set forth in part in the description which follows, and in part will be obvious from the description, or can be learned by practice of the invention. The advantages of the invention will be realized and attained by means of the elements and combinations particularly pointed out in the appended claims. It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate several aspects of the invention and together with the description, serve to explain the principles of the invention.

Figure 1A:
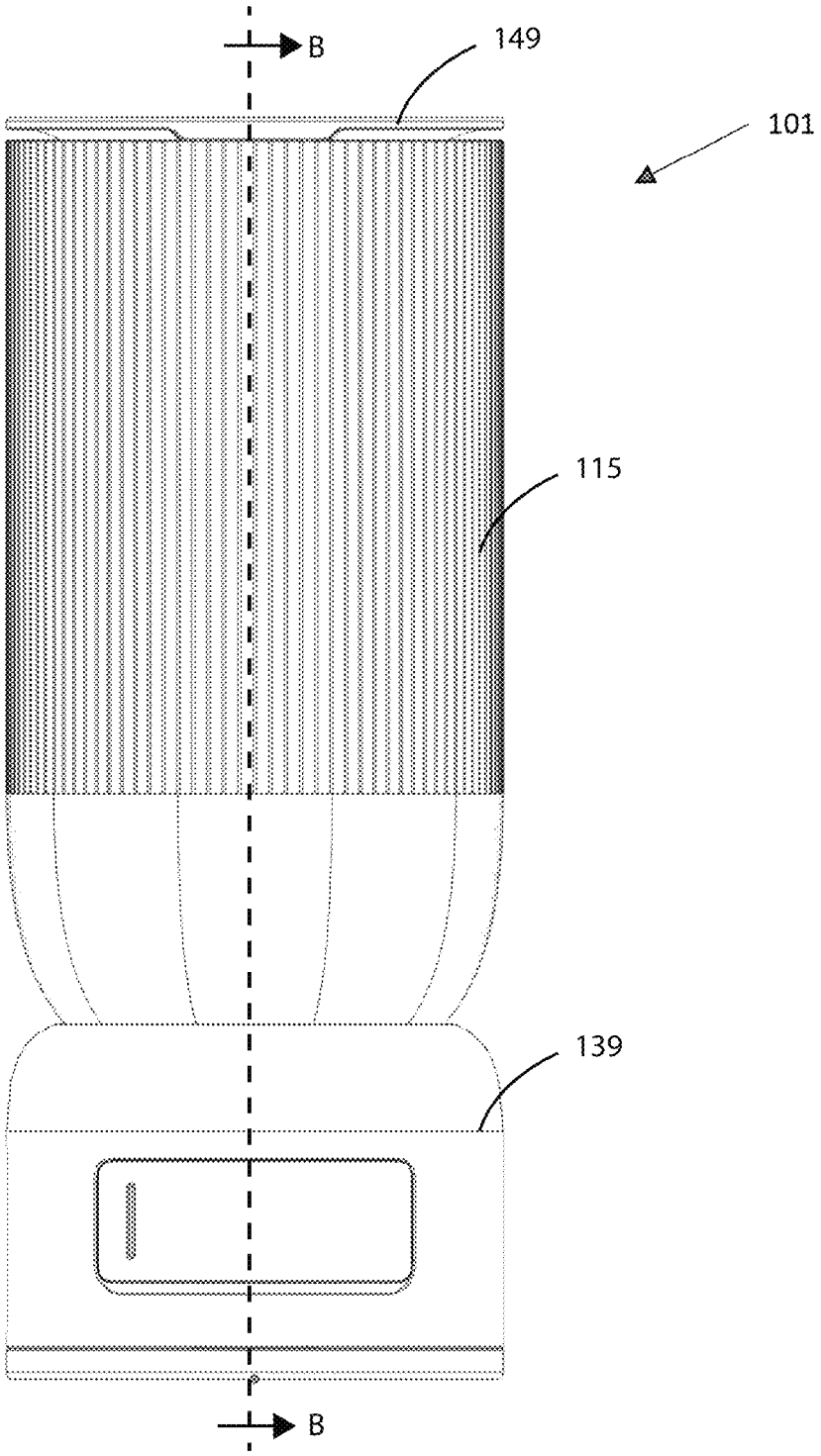
Figure 1B:
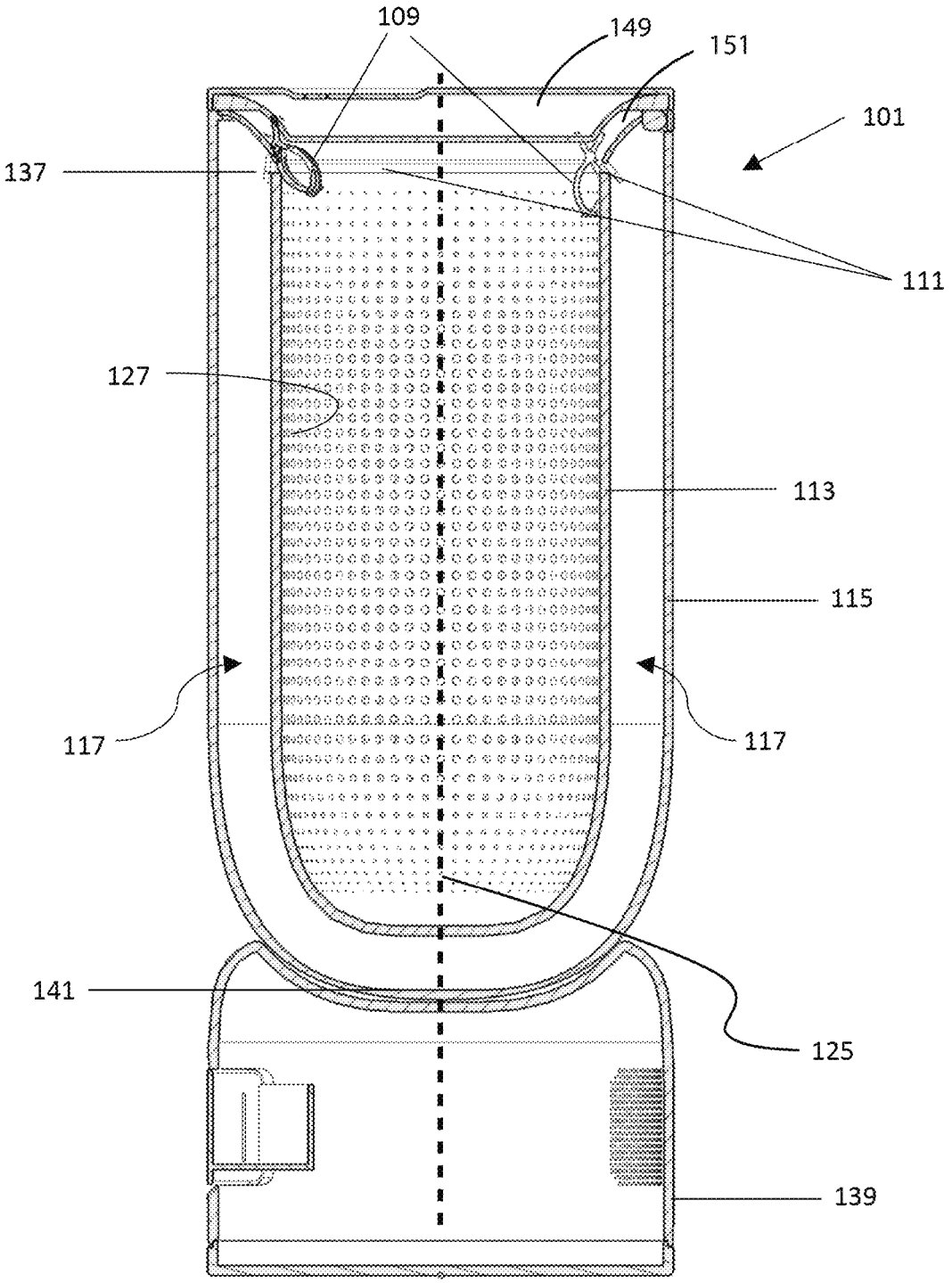
Figure 2:
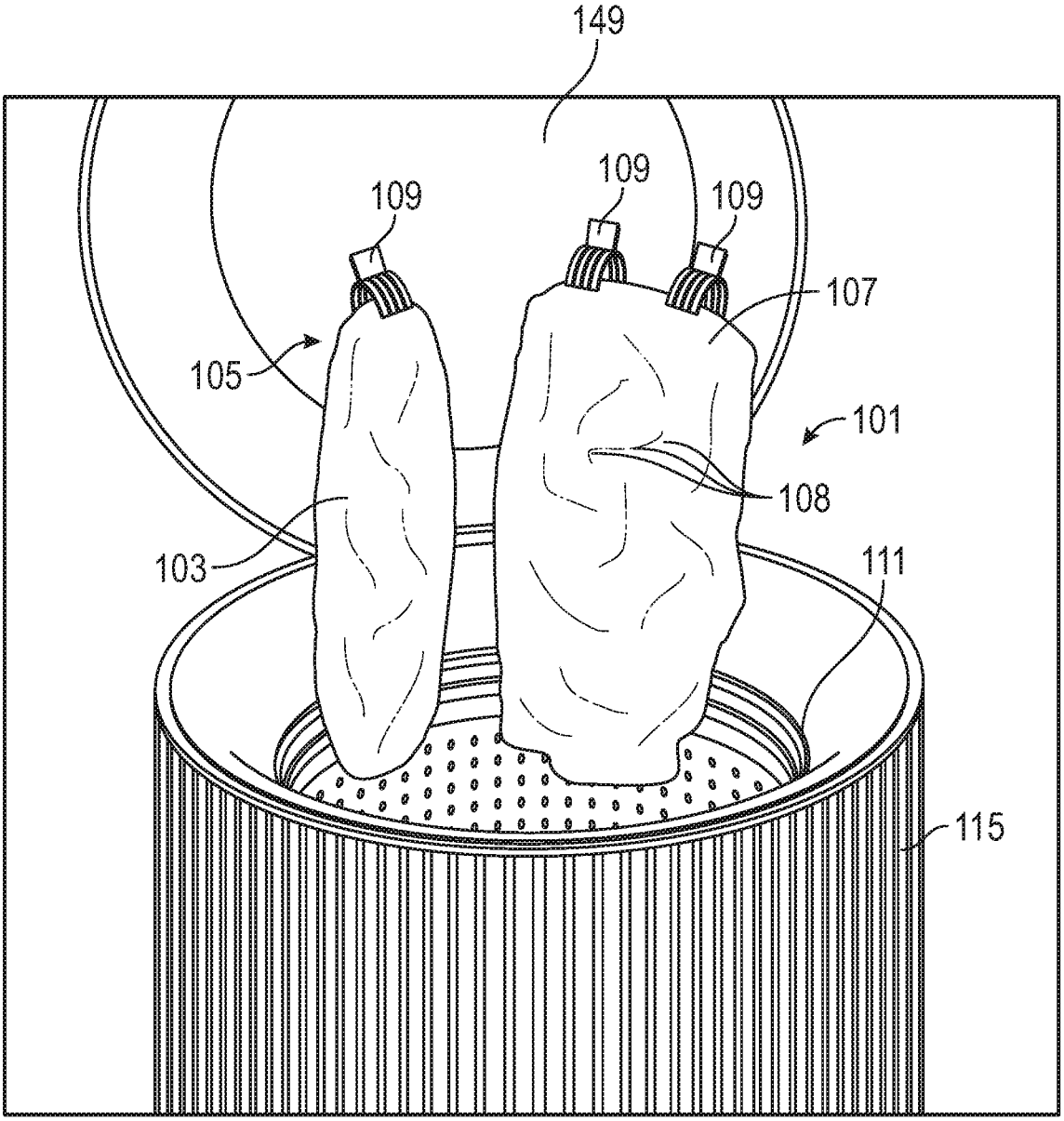
Figure 3:
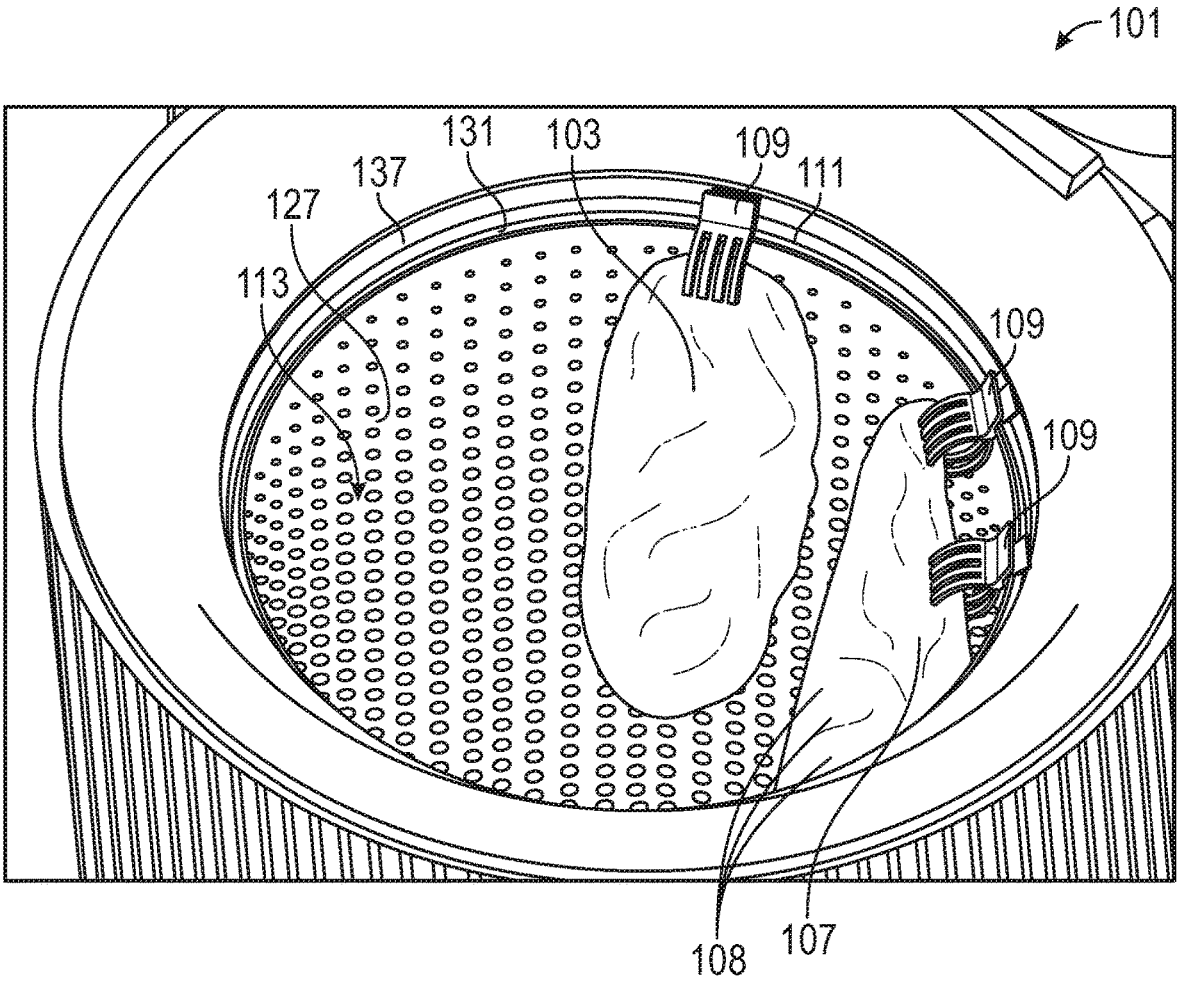
Figure 4:
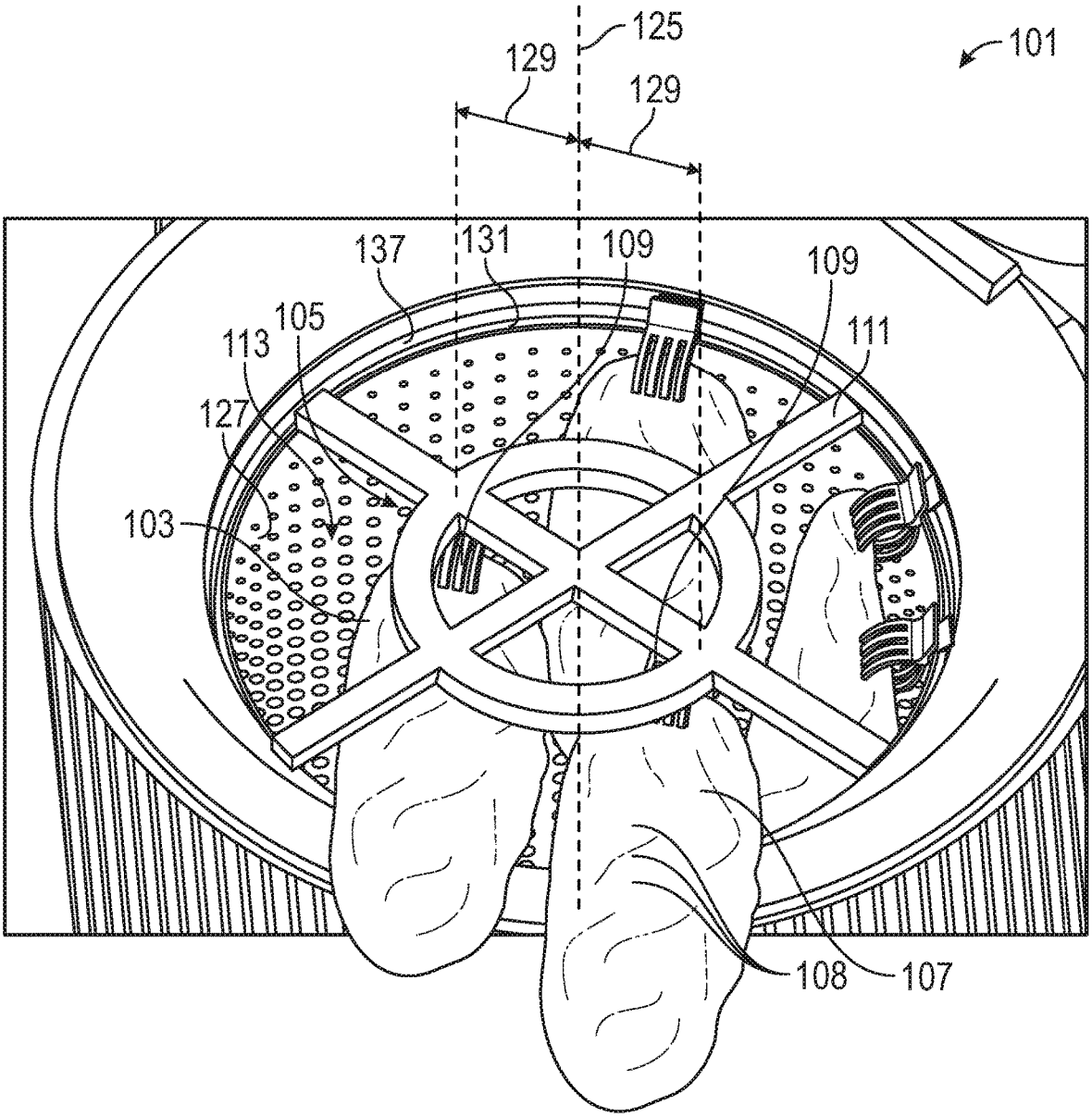
Figure 5:
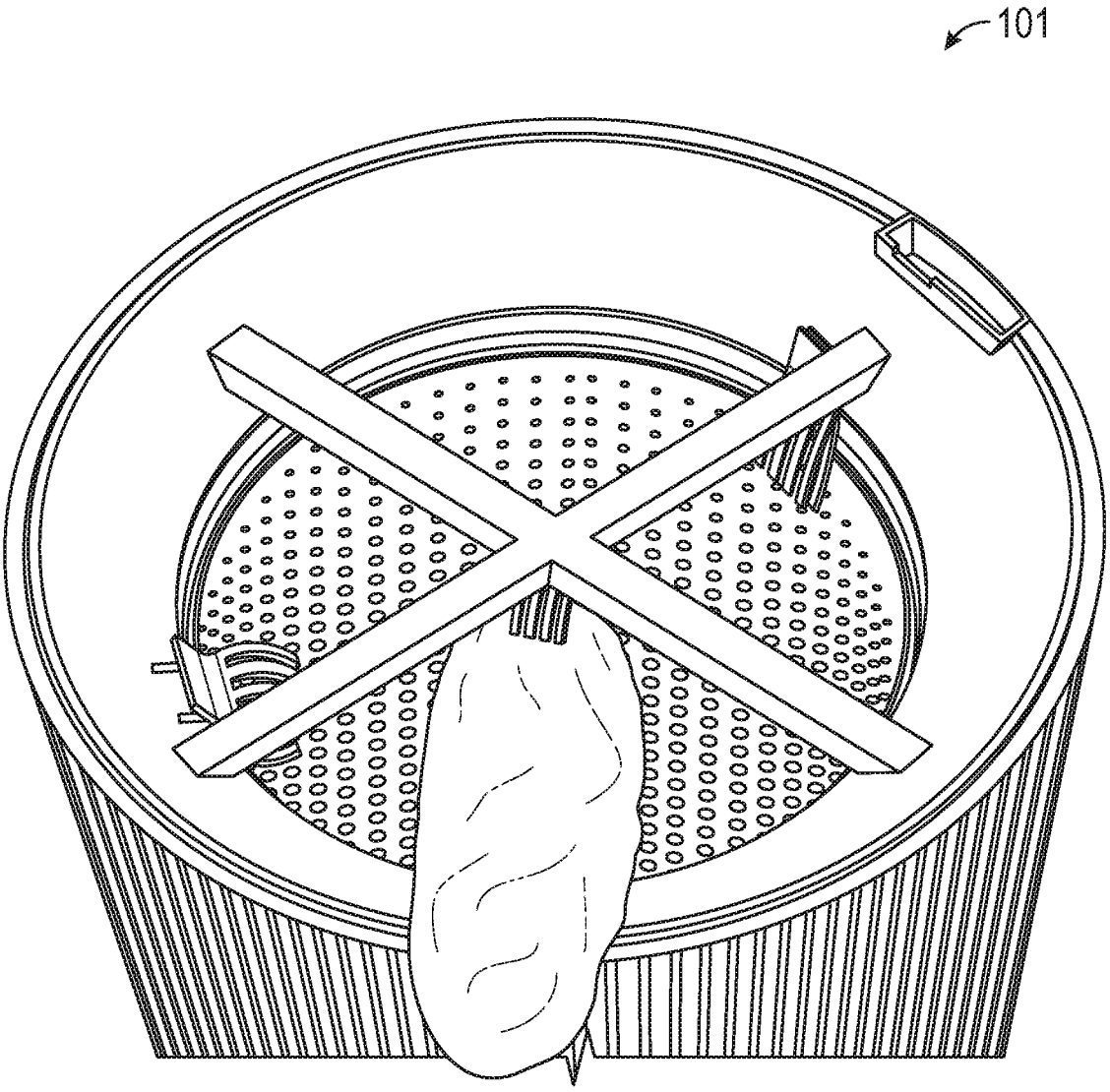
Figure 6:
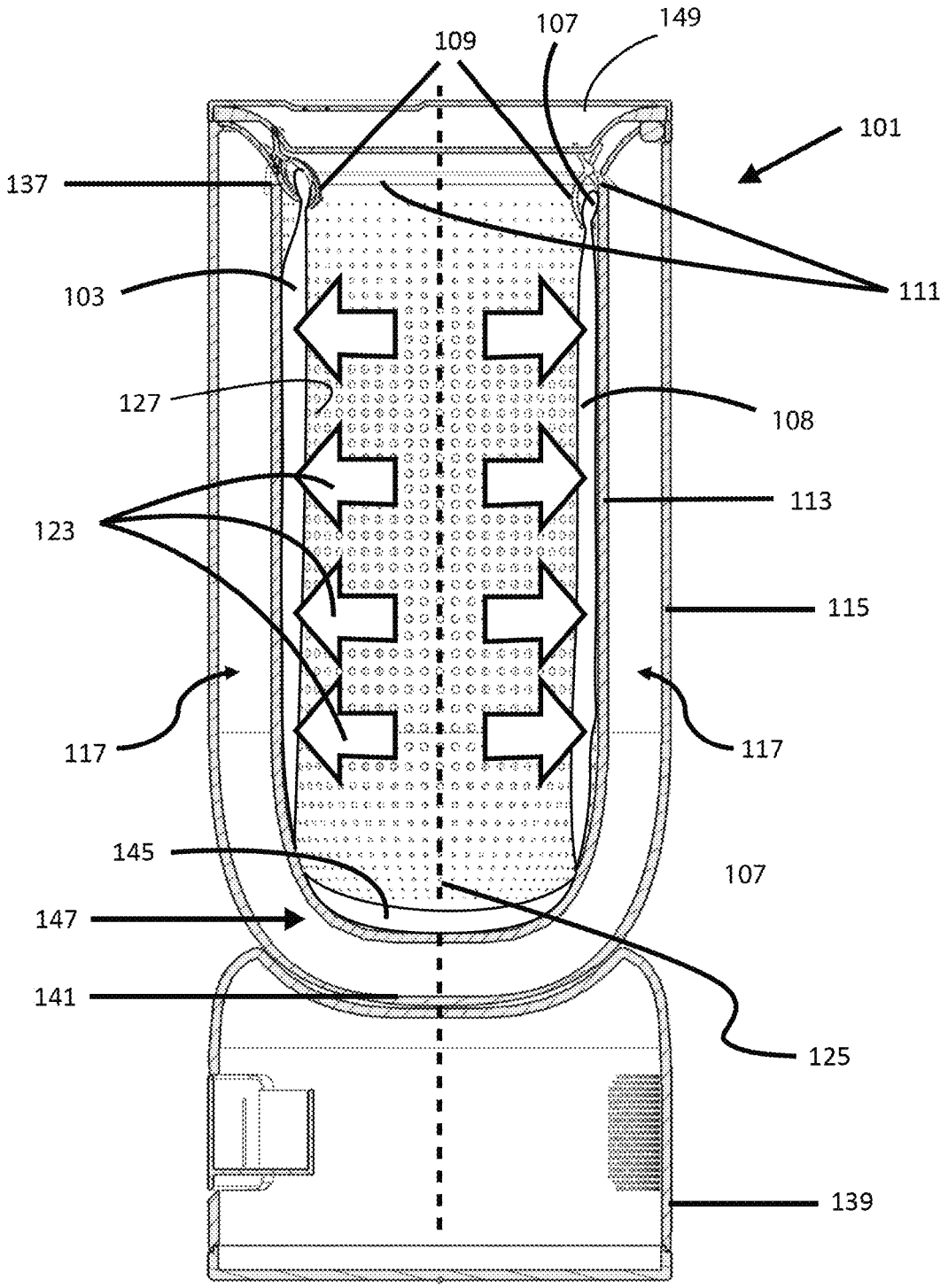
Figure 7:
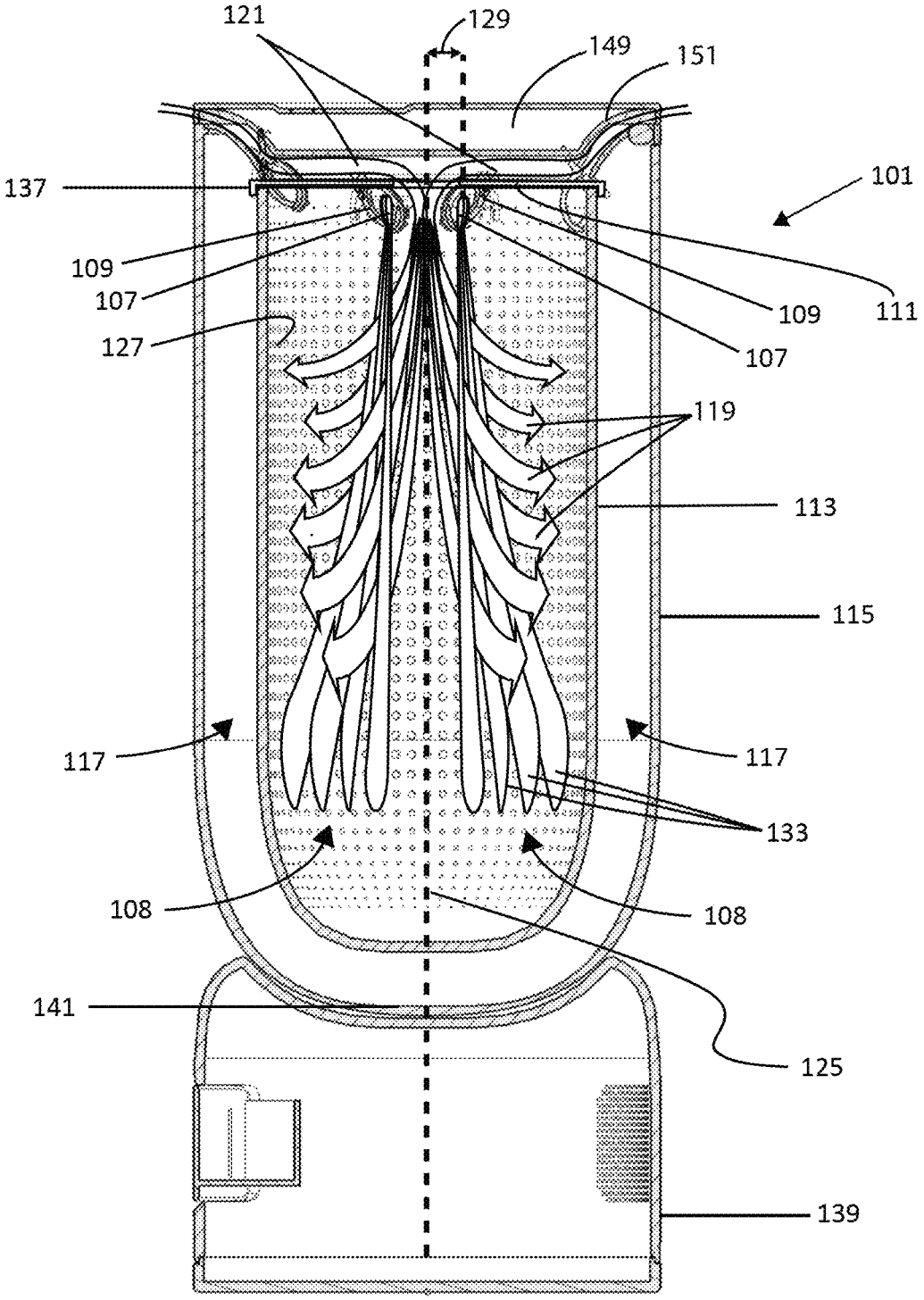
Figure 8:
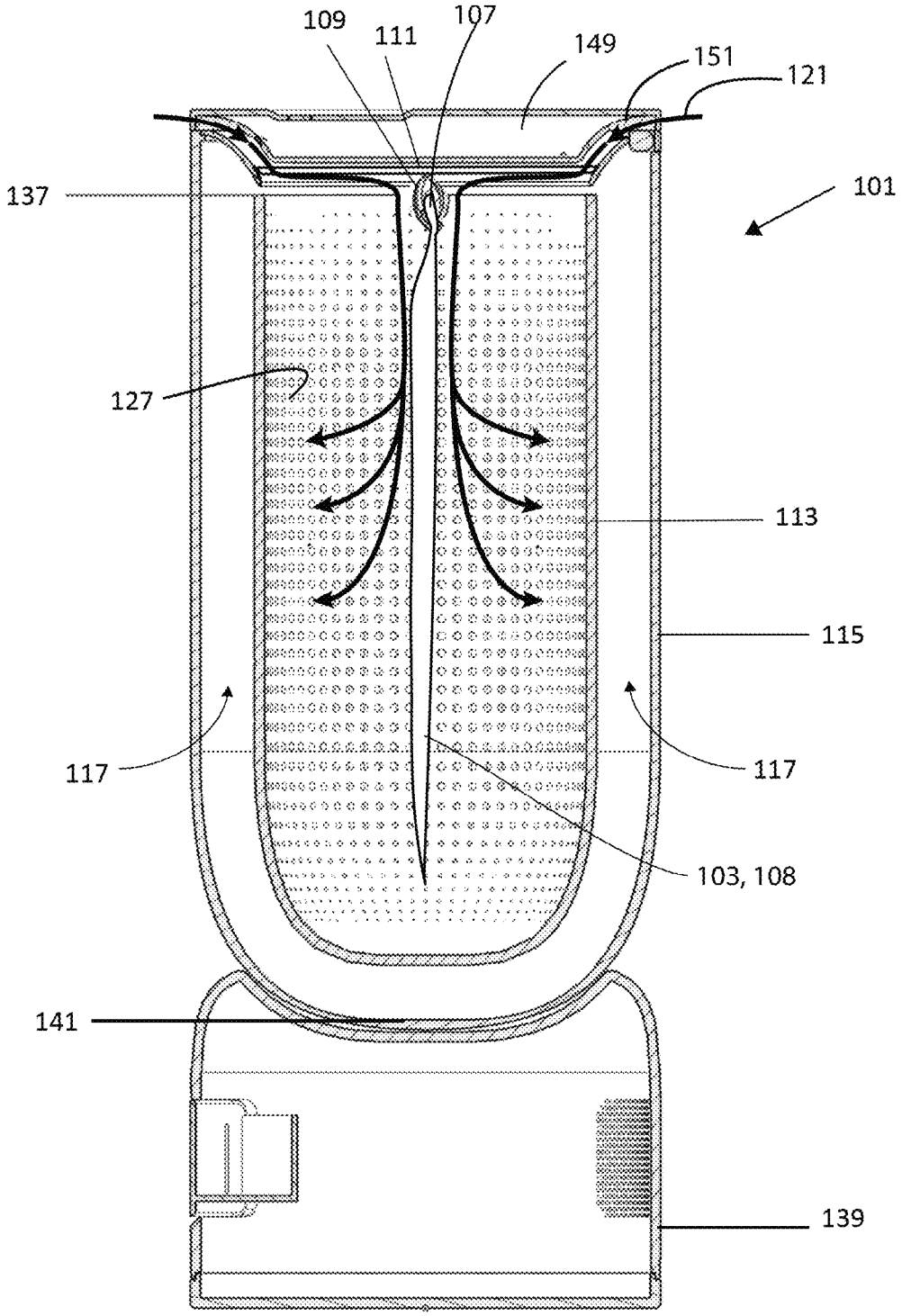
Figure 9:
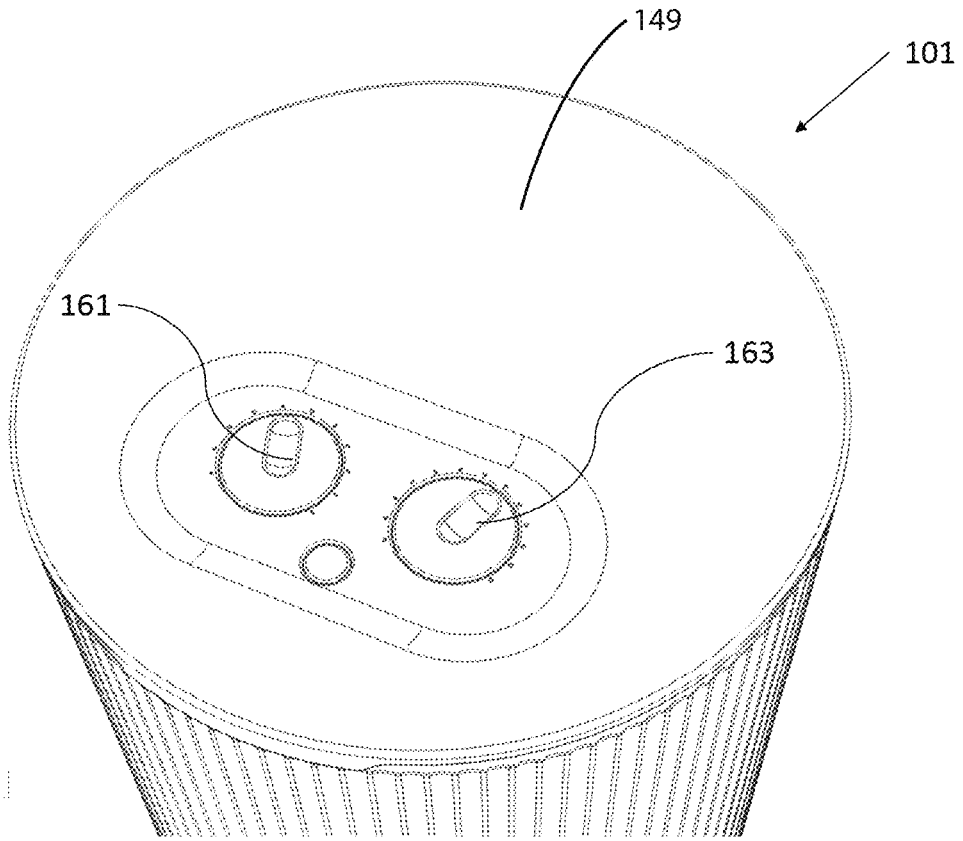
Figure 10:
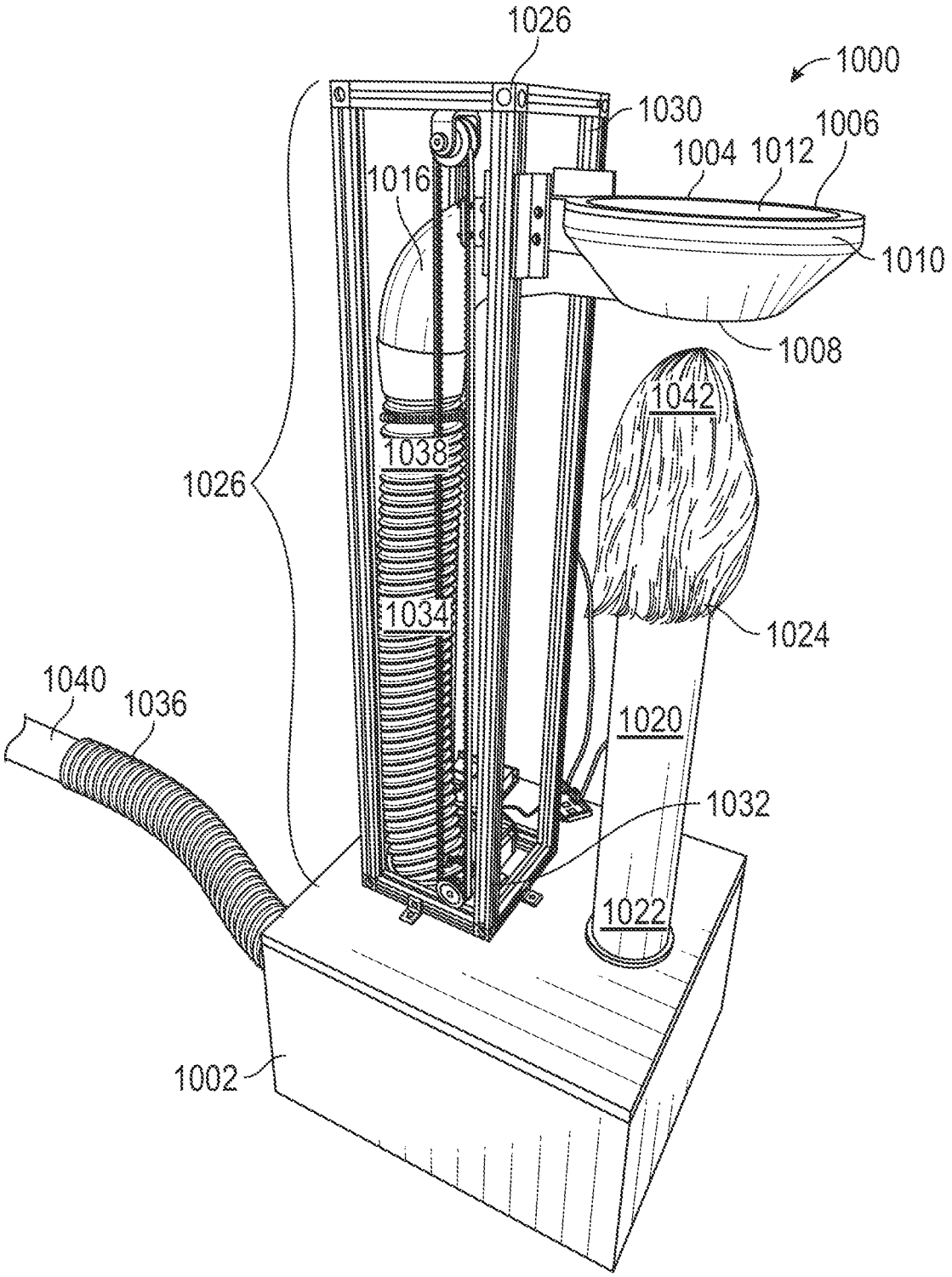
Figure 11:
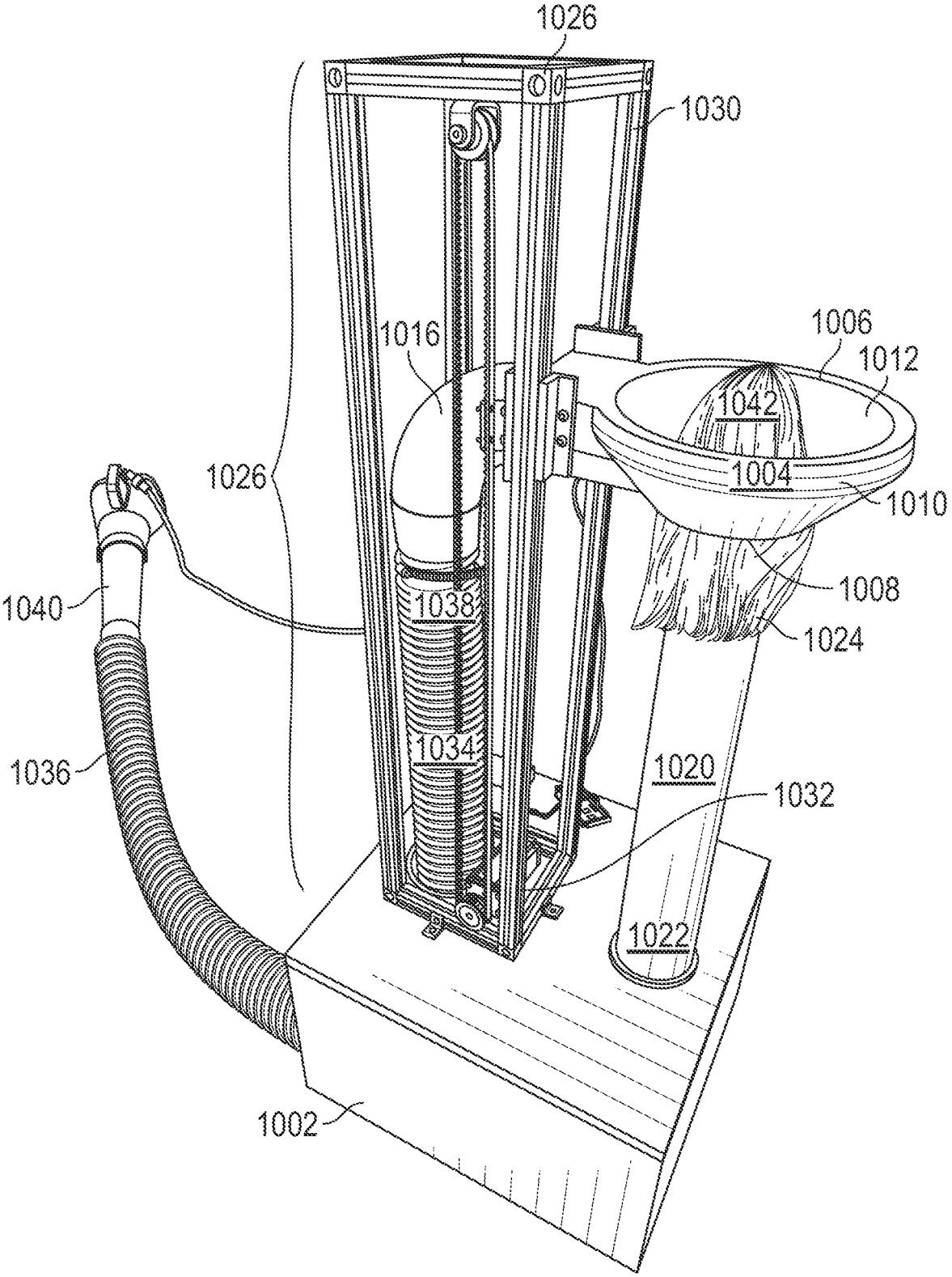
Figure 12:
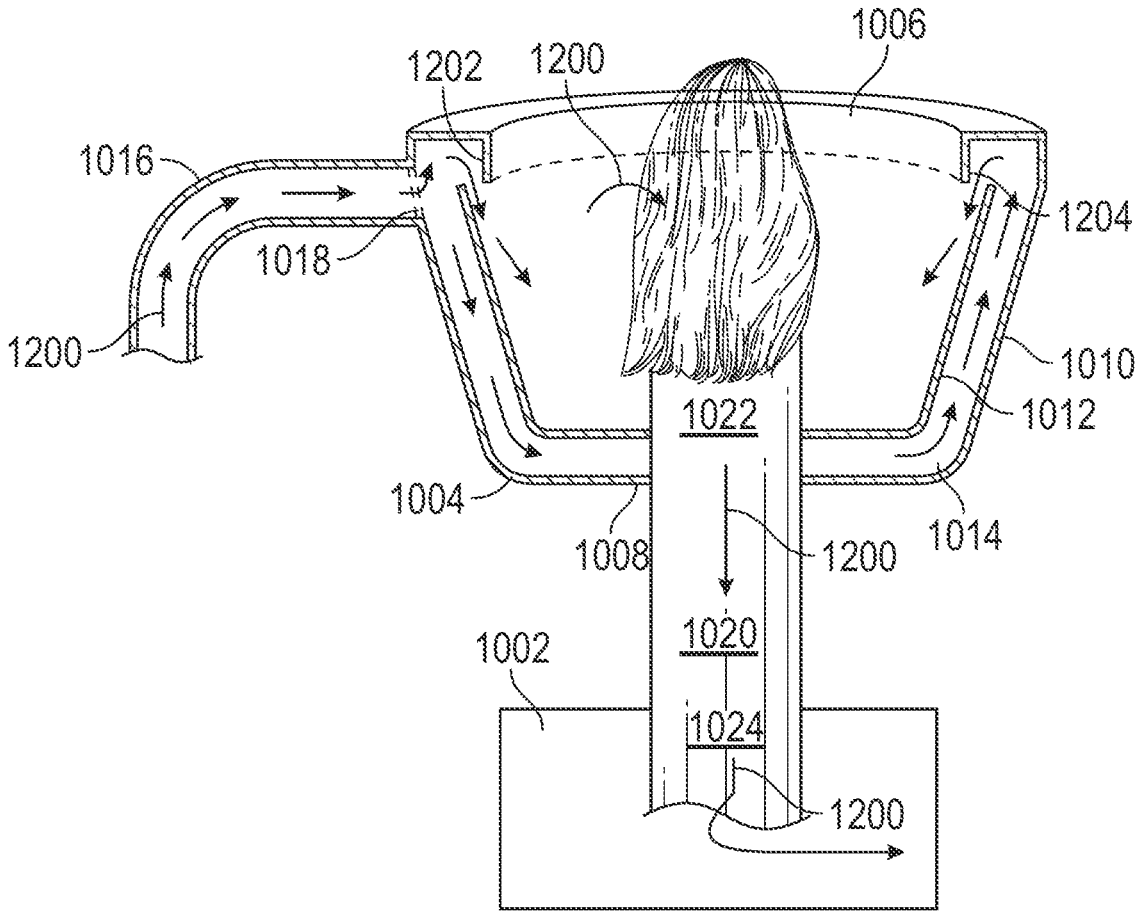
Figure 12A:
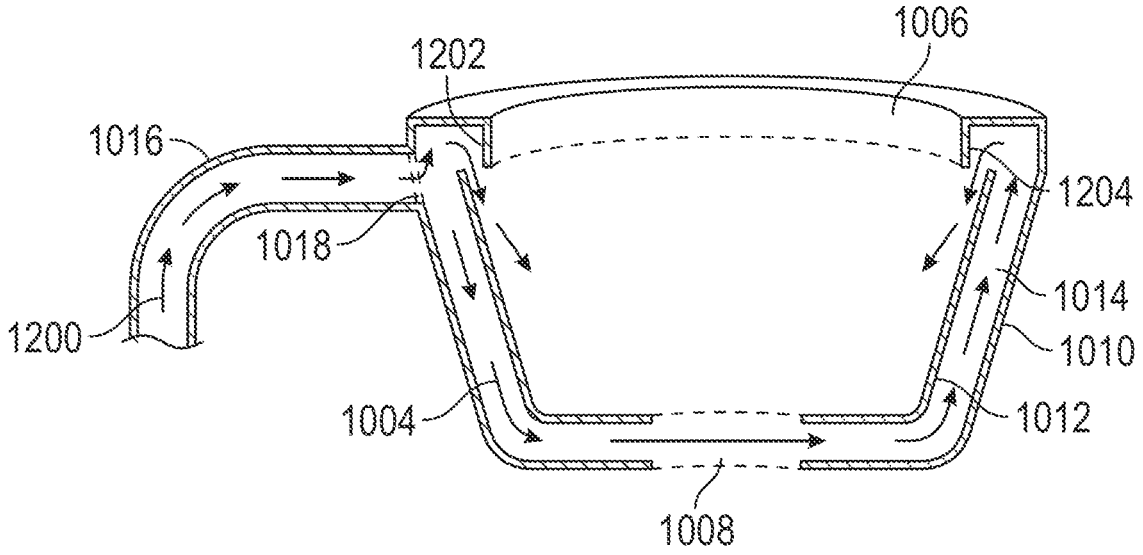
Figure 13:
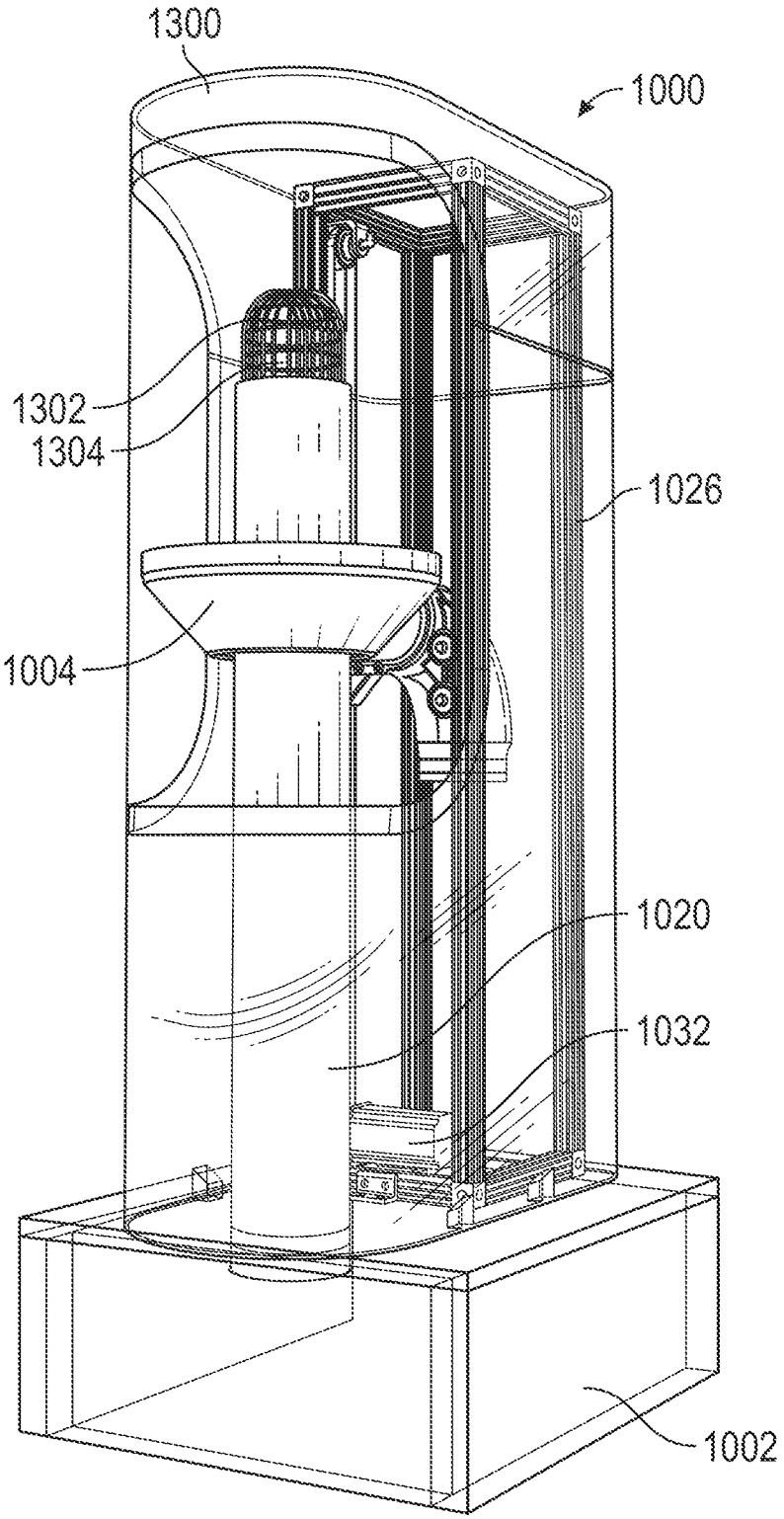
Figure 14:
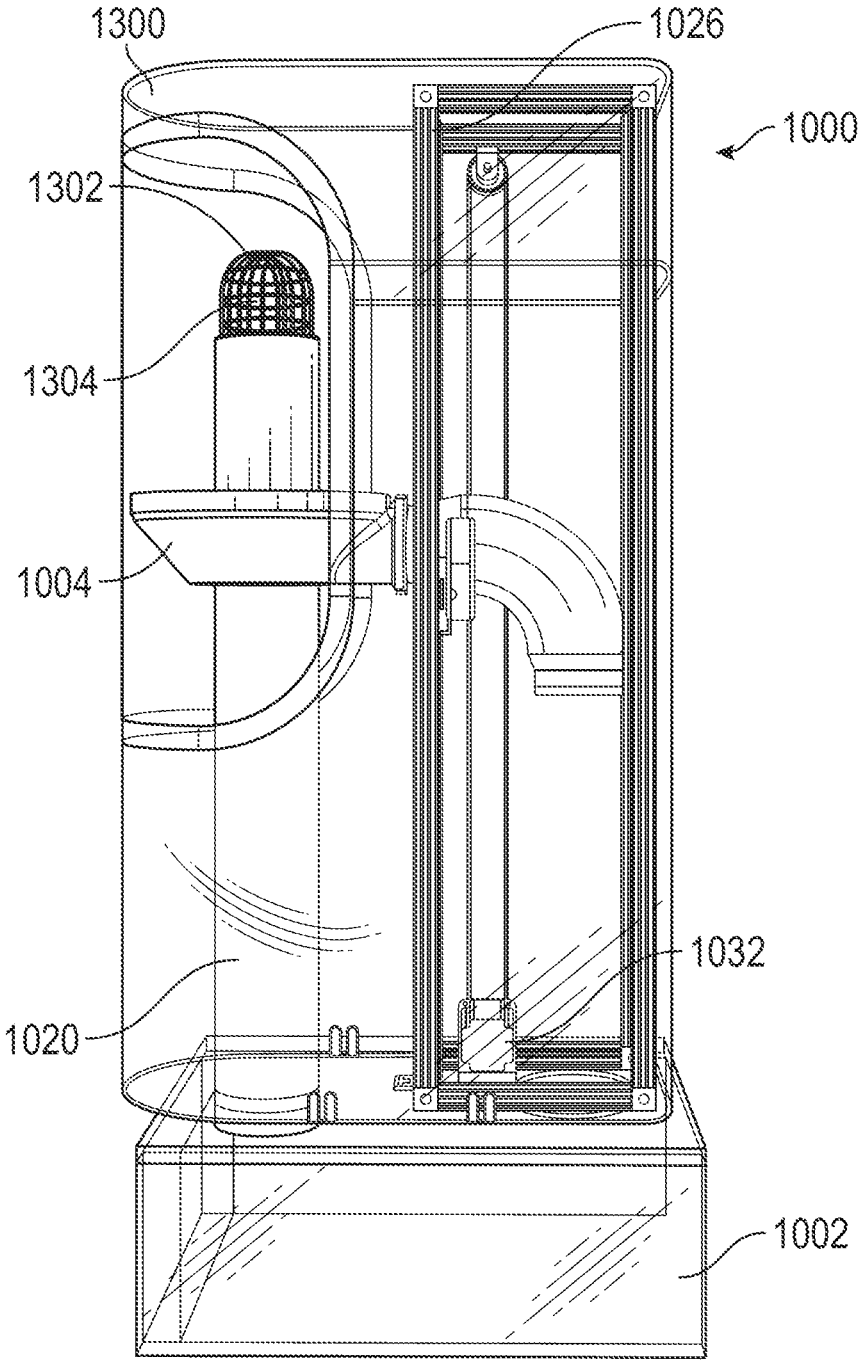
Figure 15:
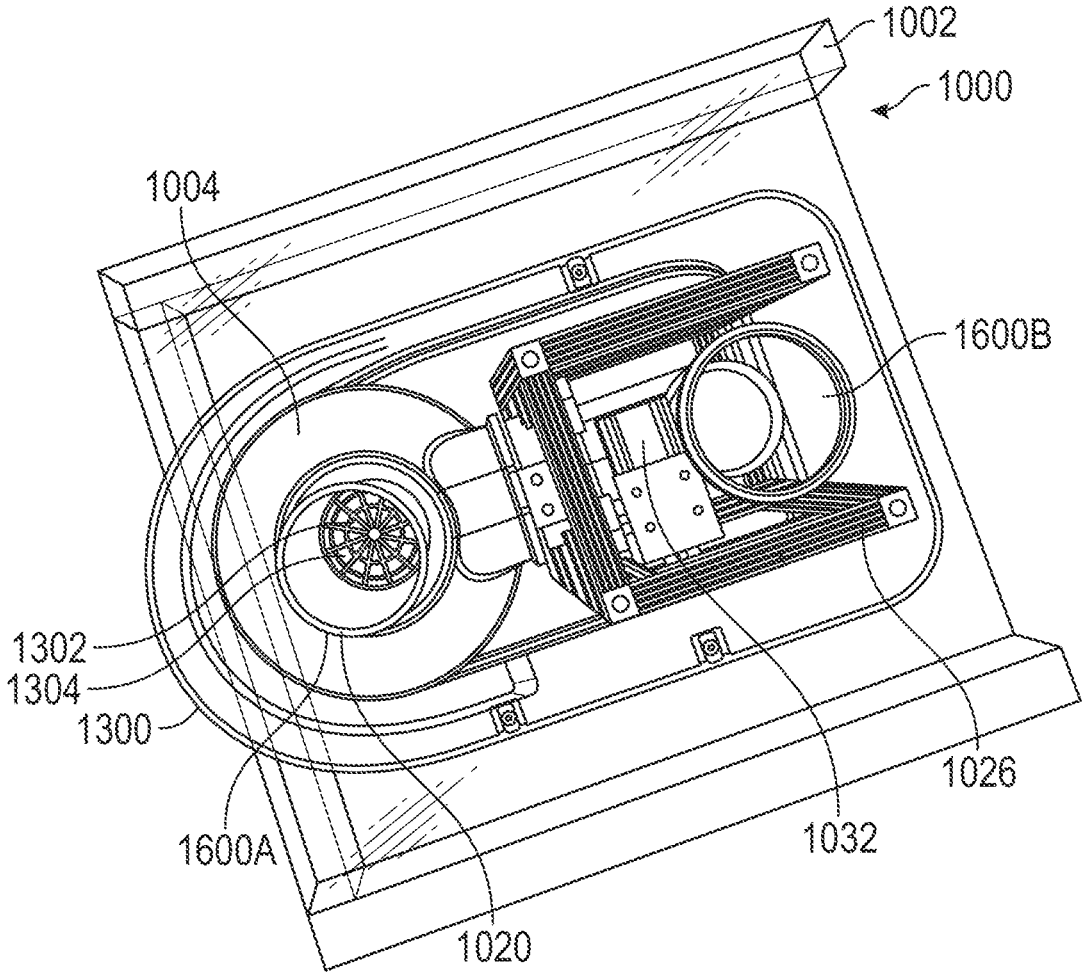
Figure 16:
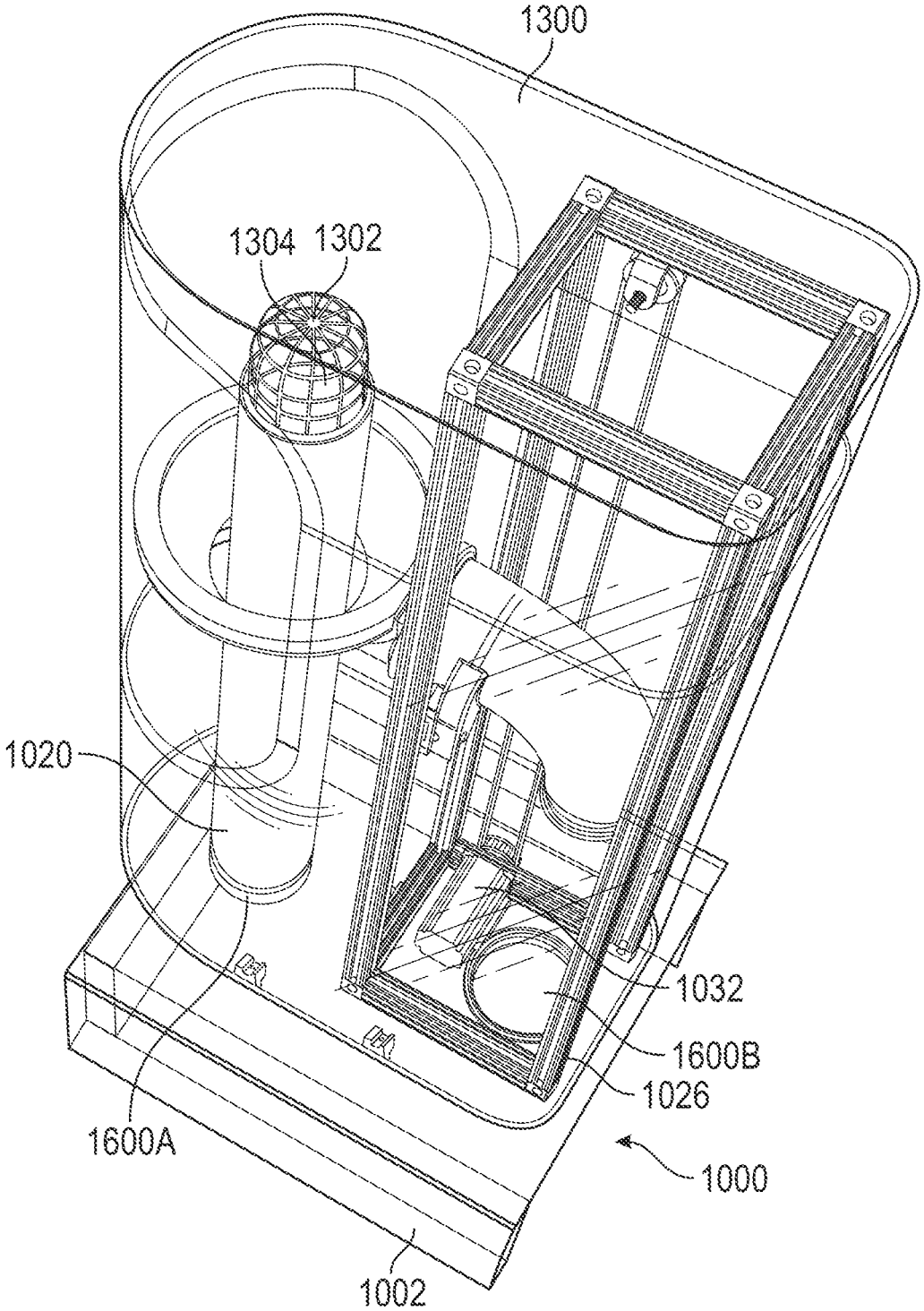
Figure 17:
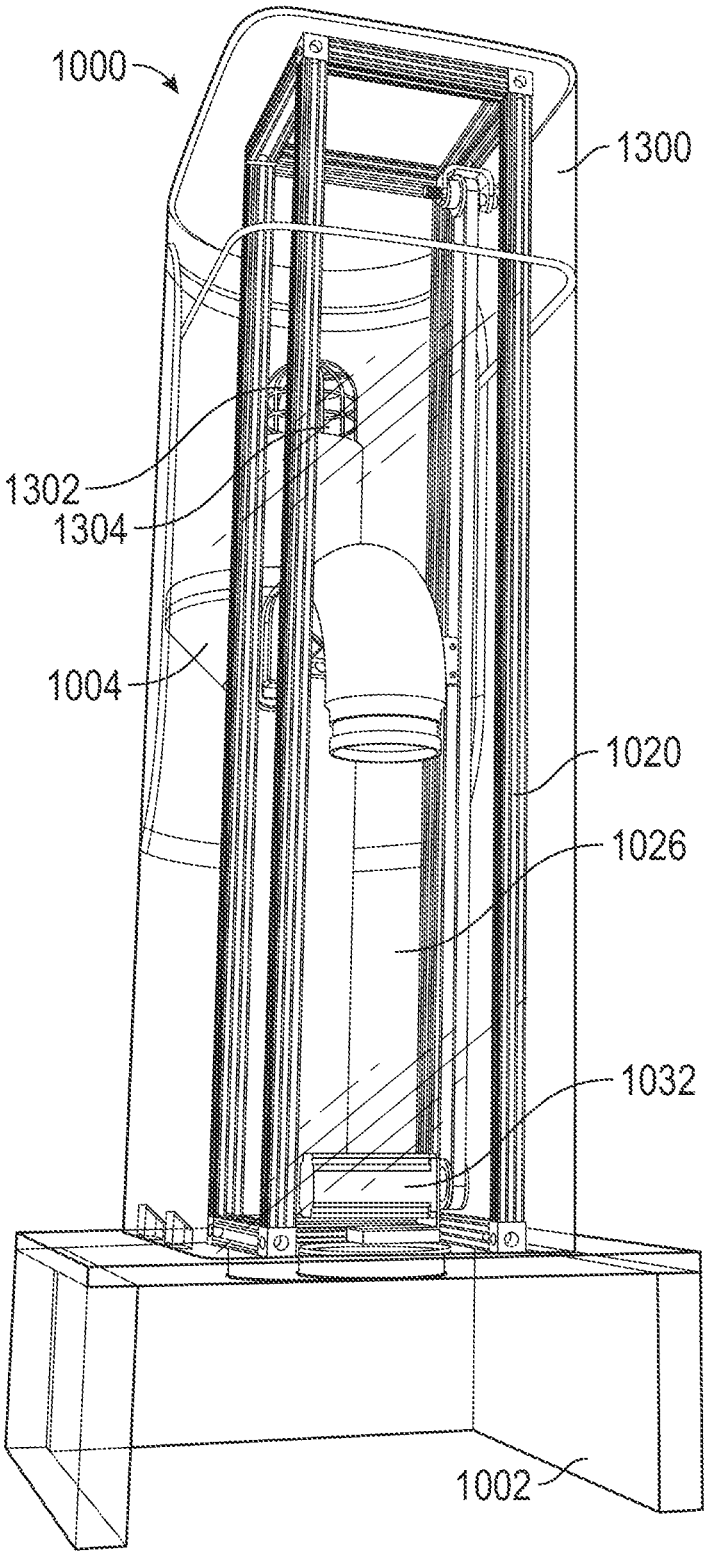
Figure 18:
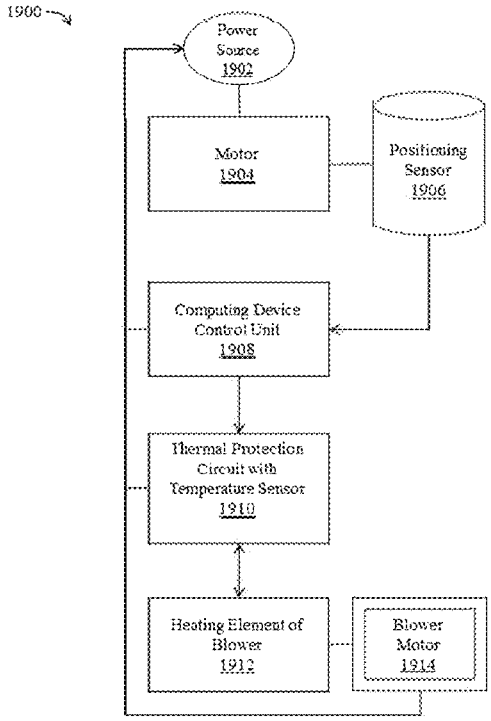
Figure 19:
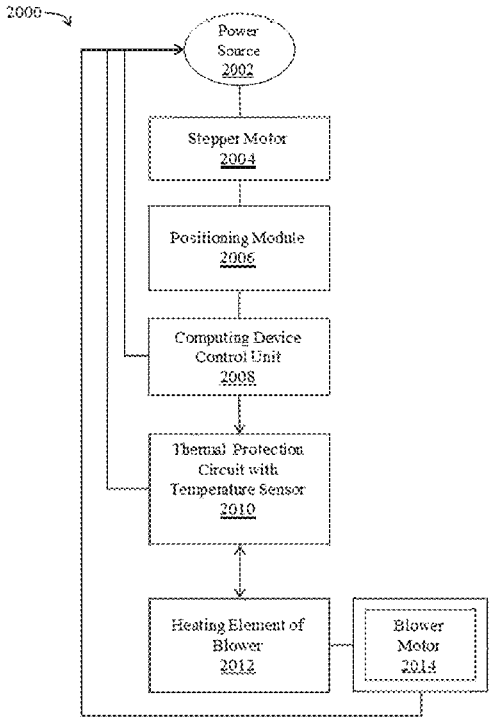

Having thus described the presently disclosed subject matter in general terms, reference will now be made to the accompanying Drawings, which are not necessarily drawn to scale, and wherein:

FIG. 1A is an elevation view of a spin and air dryer for artificial and virgin hair bundles and wigs in accordance with embodiments of the present disclosure;

FIG. 1B is a section view of a spin and air dryer for artificial and virgin hair bundles and wigs in accordance with embodiments of the present disclosure;

FIG. 2 is a close perspective view of a spin and air dryer for artificial and virgin hair bundles and wigs with a lid open over a drying chamber and showing a ply and weft of elongate strands above and prior to hanging therewithin, in accordance with embodiments of the present disclosure;

FIG. 3 is a close perspective view of a spin and air dryer for artificial and virgin hair bundles and wigs, showing a drying chamber and showing a ply and weft of elongate strands hanging from hangers seated on a hanger perch on an annular lip proximate the top of a drying chamber, in accordance with embodiments of the present disclosure;

FIG. 4 is a close perspective view of a spin and air dryer for artificial and virgin hair bundles and wigs, showing a drying chamber and showing a ply and weft of elongate strands hanging from hangers seated on a hanger perch proximate the top of a drying chamber, at a radial sweeping radius with respect to the drying chamber, in accordance with embodiments of the present disclosure;

FIG. 5 is a close perspective view of a spin and air dryer for artificial and virgin hair bundles and wigs, showing a drying chamber and showing a ply and weft of elongate strands hanging from a hanger seated on a hanger perch that is stationary with respect to a housing and above of a drying chamber, in accordance with embodiments of the present disclosure;

FIG. 6 is a section view of a spin and air dryer for artificial and virgin hair bundles and wigs, showing a drying chamber and showing a ply and weft of elongate strands hanging from hangers seated on a hanger perch on an annular lip proximate the top of a drying chamber, in accordance with embodiments of the present disclosure;

FIG. 7 is a section view of a spin and air dryer for artificial and virgin hair bundles and wigs, showing a drying chamber and showing a ply and weft of elongate strands hanging from hangers seated on a hanger perch proximate the top of a drying chamber, at a radial sweeping radius with respect to the drying chamber, in accordance with embodiments of the present disclosure;

FIG. 8 is a section view of a spin and air dryer for artificial and virgin hair bundles and wigs, showing a drying chamber and showing a ply and weft of elongate strands hanging from a hanger seated on a hanger perch that is stationary with respect to a housing and above of a drying chamber, in accordance with embodiments of the present disclosure;

FIG. 9 is a close perspective view of a spin and air dryer for artificial and virgin hair bundles and wigs with a lid closed and showing a spin parameter controller and air flow parameter controller, in accordance with embodiments of the present disclosure;

FIG. 10 shows a perspective view of automated reciprocating hair dryer having a bowl oriented in a raised position, in accordance with an exemplary embodiment of the present invention;

FIG. 11 shows a perspective view of automated reciprocating hair dryer having a bowl oriented in a lower position, in accordance with an exemplary embodiment of the present invention;

FIG. 12 shows a side cut-away view of the airflow through the protruding structure into the chamber of the bowl and being discharged through a discharge opening of the bowl when the bowl is oriented in a lower position around a pipe, in accordance with an exemplary embodiment of the present invention;

FIG. 12A shows a side cut-away view of the airflow through the protruding structure into the chamber of the bowl and being discharged through a discharge opening of the bowl, in accordance with an exemplary embodiment of the present invention;

FIG. 13 shows a perspective cut-away view of the automated reciprocating hair dryer having a housing connected to a base, the housing retaining a bowl oriented in a lower position around a pipe, in accordance with an exemplary embodiment of the present invention;

FIG. 14 shows a side perspective cut-away view of the automated reciprocating hair dryer having a housing connected to a base, the housing retaining a bowl oriented in a lower position around a pipe, in accordance with an exemplary embodiment of the present invention;

FIG. 15 shows a rear cut-away view of the automated reciprocating hair dryer having a housing connected to a base, the housing retaining a bowl oriented in a lower position around a pipe, in accordance with an exemplary embodiment of the present invention;

FIG. 16 shows a top cut-away view of the automated reciprocating hair dryer having a housing connected to a base, the housing retaining a bowl oriented in a lower position around a pipe, in accordance with an exemplary embodiment of the present invention;

FIG. 17 shows a front cut-away view of the automated reciprocating hair dryer having a housing connected to a base, the housing retaining a bowl oriented in a lower position around a pipe, in accordance with an exemplary embodiment of the present invention;

FIG. 18 shows a schematic block diagram illustrating circuitry of the dryer system having a motor, in accordance with an exemplary embodiment of the present invention; and, FIG. 19 shows a schematic block diagram illustrating circuitry of the dryer system having a stepper motor, in accordance with an exemplary embodiment of the present invention.

Reference is made in the following detailed description to accompanying drawings, which form a part hereof, wherein like numerals may designate like parts throughout that are corresponding and/or analogous. It will be appreciated that the figures have not necessarily been drawn to scale, such as for simplicity and/or clarity of illustration. For example, dimensions of some aspects may be exaggerated relative to others. Further, it is to be understood that other embodiments may be utilized. Furthermore, structural and/or other changes may be made without departing from claimed subject matter. References throughout this specification to "claimed subject matter" refer to subject matter intended to be covered by one or more claims, or any portion thereof, and are not necessarily intended to refer to a complete claim set, to a particular combination of claim sets (e.g., method claims, apparatus claims, etc.), or to a particular claim. It should also be noted that directions and/or references, for example, such as up, down, top, bottom, and so on, may be used to facilitate discussion of drawings and are not intended to restrict application of claimed subject matter. Therefore, the following detailed description is not to be taken to limit claimed subject matter and/or equivalents.

DETAILED DESCRIPTION OF THE INVENTION

The following detailed description is made with reference to the figures. Exemplary embodiments are described to illustrate the disclosure, not to limit its scope, which is defined by the claims. Those of ordinary skill in the art will recognize a number of equivalent variations in the description that follows.

Articles "a" and "an" are used herein to refer to one or to more than one (i.e. at least one) of the grammatical object of the article. By way of example, "an element" means at least one element and can include more than one element.

"About" is used to provide flexibility to a numerical endpoint by providing that a given value may be "slightly above" or "slightly below" the endpoint without affecting the desired result.

The use herein of the terms "including," "comprising," or "having," and variations thereof is meant to encompass the elements listed thereafter and equivalents thereof as well as additional elements. Embodiments recited as "including," "comprising," or "having" certain elements are also contemplated as "consisting essentially of" and "consisting" of those certain elements.

Recitation of ranges of values herein are merely intended to serve as a shorthand method of referring individually to each separate value falling within the range, unless otherwise indicated herein, and each separate value is incorporated into the specification as if it were individually recited herein. For example, if a range is stated as between 1%-50%, it is intended that values such as between 2%-40%, 10%-30%, or 1%-3%, etc. are expressly enumerated in this specification. These are only examples of what is specifically intended, and all possible combinations of numerical values between and including the lowest value and the highest value enumerated are to be considered to be expressly stated in this disclosure.

Unless otherwise defined, all technical terms used herein have the same meaning as commonly understood by one of ordinary skill in the art to which this disclosure belongs.

Referring to FIGS. 1A and 1B, what is shown are an elevation view and section view of a spin and air dryer 101 for artificial and virgin hair bundles. FIGS. 1A and 1B both show a lid 149, a housing 115, and a base 139. FIG. 1B is a section view of the same spin and air dryer 101.

In at least one contemplated embodiment, the base may comprise a motor configured to at least one of rotate the drying chamber 113, motivate airflow, and/or function as a source of airflow, such as by being located proximate the bottom 141 of the airflow volume 117.

FIG. 1B further shows hangers 109. These hangers 109 are configured to engage a ply 103 having a handle end 105, such as a weft 107 of plural elongate or depending materials, such as a ply comprising co-hemmed elongate strands of hair 108 having a hem (see FIG. 2). FIG. 1B further shows a hanger perch 111 configured to support the hangers 109 above a drying chamber 113 and a housing 115 defining an airflow volume 117 configured to enclose the drying chamber 113 therein, wherein the drying chamber 113 is rotatably supported within the housing 115, such that the device is configured to vertically support the weft 107 (see FIG. 2, and/or additionally the ply of strands of hair 108) within the drying chamber 113 and be alternately supported at least one of in a path 119 of a flow of drying air 121 through (see FIGS. 7 and 8) and under centrifugal force 123 (see FIG. 6) within the drying chamber 113. The chamber 113 comprises a rotation axis 125, and there is a top of the drying chamber 113 and base 139 of the air volume 117 also indicated.

FIG. 2 shows close perspective views of a spin and air dryer 101 for artificial and virgin hair bundles and wigs with a lid 149 open over a drying chamber 113 and showing a ply 103 and weft 107 of hair 108 (see also elongate strands 133, FIG. 7) above and prior to hanging therewithin, in accordance with embodiments of the present disclosure.

With respect to FIGS. 1B and 2, at least one contemplated embodiment of a method of drying a pliant elongate ply 103 having a handle end 105 may comprise: engaging the handle end 105 of the ply 103 with a hanger 109; supporting the hanger 109 above the drying chamber 113 with the hanger perch 111; enclosing the drying chamber 113 within a housing 115, defining an airflow volume 117; and rotatably supporting the drying chamber 113 with respect to the housing 115, such that the ply 103 is supported vertically within the drying chamber 113 and alternately supported at least one of in a path 119 of a flow of drying air 121 and under centrifugal force 123 within the drying chamber 113.

FIGS. 3-5 show close perspective views of a spin and air dryer 101 for artificial and virgin hair bundles and wigs. Like FIG. 2, there is a drying chamber 113 and there is shown a ply 103 and weft 107 of hair 108 hanging from hangers 109 seated on a hanger perch 111.

In FIG. 3, the hanger perch 111 is on an annular lip 131 proximate the top of the drying chamber 113. In this position, the perch 111 is stationary relative to the drying chamber 113. Specifically, this means that rotation of the drying chamber 113 would rotate the perch 111, and therefore also the hangers 109 and ply 103 and weft 107 (and hair 108) thereon. For further discussion of an embodiment similar to the one shown in FIG. 3, see FIG. 6.

In FIG. 4, the hanger perch 111 is proximate the top 137 of a drying chamber 113, and the hangers 109 holding the ply 103 and weft 107 are located at a radial sweeping radius 129 with respect to the drying chamber 113 (as measured from an axis 125), in accordance with embodiments of the present disclosure. In this position, the perch 111, hangers 109, ply 103, and weft 107 are stationary with respect to the drying chamber 113. Specifically, this means that rotation of the drying chamber 113 would rotate the perch 111, and therefore also the hangers 109 and ply 103 and weft 107 thereon. For further discussion of an embodiment similar to the one shown in FIG. 4, see FIG. 7.

The hanger perch 111 is on an annular lip 131 proximate the top 137 of the drying chamber 113. In this position, the perch 111 is stationary relative to the drying chamber 113. Specifically, this means that rotation of the drying chamber 113 would rotate the perch 111, and therefore also the hangers 109 and ply 103 and weft 107 thereon.

In FIG. 5, the hanger perch 111 is stationary with respect to the housing 115 and is above the drying chamber 113. This means that the perch 111, hangers 109, ply 103, and weft 107 will all remain motionless, unaffected by motion and other rotation of the drying chamber 113. For further discussion of an embodiment similar to the one shown in FIG. 5, see FIG. 8.

Referring now to FIG. 6, FIG. 6 shows a section view of a spin and air dryer 101 for artificial and virgin hair bundles and wigs that is similar to that shown in FIG. 1B, and further shows a ply 103 and weft 107 of hair 108 (of elongate strands 133 see FIG. 7) hanging from hangers 109 seated on a hanger perch 111 (see also hanger perch 111 on an annular lip 131, FIGS. 3-5) proximate the top 137 of the drying chamber 113. The drying chamber 113 comprises a rotation axis 125 and an interior wall 127, and wherein the hanger perch 111 is configured to support the hanger 109 offset from the rotation axis and in such proximity to the interior wall 127, such that rotating the chamber 113 imposes a centrifugal force 123 on at least one of the ply 103, the weft 107 and/or the hair 108. In such a method, wherein the centrifugal force 123 is sufficiently large to express moisture 145 from the ply 103, weft 107 and/or hair 108, the centrifugal force would thereby effect ejection of the moisture 145 out of the chamber 113 and/or facilitate collecting the moisture 145 from the drying chamber 113 with at least one of a reservoir 147 and exit conduit. In the present FIG. 6, the drying chamber 113 is shown rotating, with moisture 145 accumulated in one type of contemplated reservoir 147 at the bottom of the chamber 113, though no exit conduit or other type of reservoir is shown, nor is any moisture 145 shown being ejected from the chamber 113, though it should be understood that contemplated drying chambers comprise ones having perforations and other features configured to allow such ejection of moisture 145 from the chamber 113.

Referring now to FIGS. 7 and 8: FIGS. 7 and 8 show distinct section views of embodiments of a spin and air dryer 101 configured to dry artificial and virgin hair bundles and wigs. Both figures show a drying chamber 113 each showing a ply 103 and weft 107 of elongate strands 133 hanging from hangers 109 seated on a hanger perch 111.

Referring now to FIG. 7, though, the perch 111 is located proximate the top 137 of the drying chamber 113 and is in a position at which it is stationary with respect to the drying chamber 113. Further, the hangers 109 are seated on the perch 111 at a radial sweeping radius 129 with respect to the drying chamber.

Specifically, the drying chamber 113 comprises a rotation axis 125 and an interior wall 127. The hanger perch 111 is configured to support the hangers 109 at a radially-sweeping radius 129, a radially-sweeping radius 129 being one that is offset from the rotation axis 125 and inset from the interior wall 127. Therefore, the dryer 101 is further configured to impose a centrifugal force 123 to the ply 103 (and/or weft 107 and/or hair 108) with the drying chamber 113, to at least one of radially sweep the ply 103 away from the rotation axis 125 (to increasing degree and/or distance, with increasing distance from the top of the drying chamber 137) and/or, for a ply 103 or hair 108 supported from a weft 107 comprising a plurality of elongate strands 133, radially and/or angularly sweeps the strands 133 away from one another.

The embodiment shown in FIG. 7 is also one that is configured to arrange the ply 103 and weft 107 and hair 108 and elongate strands 133 in the path 119 of a drying flow of air 121, though this is not strictly necessary for achieving drying with this embodiment. While radially and/or angularly spreading a ply 103 or elongate strands 133 of hair 108 with respect to a weft 107 can be enhanced with augmenting with a flow of air in any particular direction, one method of doing such drying would arrange the drying flow of air 121 as shown in the figure, where it is projected radially and outward with respect to the axis 125 of rotation of the drying chamber 113.

Referring now to FIG. 8, though, the perch 111 is stationary with respect to the housing 115 (see also FIG. 5), and above the drying chamber 113. Further, the hanger 109 shown supports one of a weft 107 of hair 108 or ply 103, to hang the elongate materials thereof vertically within the drying chamber 113. In this arrangement, the hanger 109 is seated on the perch 111 at a location isolated from rotation of the drying chamber 113.

In both of FIGS. 7 and 8 (as well as in FIG. 6), the housing 115 comprises a lid 149 above the airflow volume 117 that is configured to guide airflow with at least one of vanes and intake geometry 151, and further guide a drying flow of air 121 into the housing 115 with the lid 149.

Though not shown here specifically, beyond the contemplated intake geometry 151 of the lid 149, there are further contemplated embodiments wherein the housing 115 comprises airflow control geometry configured to accelerate a drying flow of air 121 into the drying chamber 113 with a source of motivated airflow proximate the base 139 of the housing 115.

Referring now to FIG. 9, FIG. 9 shows a close perspective view of a spin and air dryer 101, with a lid 149 closed and showing a spin parameter controller 161 and air flow parameter controller 163, in accordance with embodiments of the present disclosure.

The spin parameter controller 161 is configured to allow for selecting at least one of a duration and intensity of rotational motion, spin, and/or centrifugal force 123 (see FIGS. 6, 7). The spin parameter controller 161 shown appears as a knob in this case, but contemplated embodiments include ones selected from a list comprising a knob, a button, and/or a control panel/multi-mode interface.

The air flow parameter controller 163 is configured to allow for selecting at least one of a duration and intensity of airflow through the airflow volume 117 (see FIGS. 7, 8). The air flow parameter 163 controller shown appears as a knob in this case, but contemplated embodiments include ones selected from a list comprising a knob, a button, and/or a control panel/multi-mode interface.

While the embodiments have been described in connection with the various embodiments of the various figures, it is to be understood that other similar embodiments may be used, or modifications and additions may be made to the described embodiment for performing the same function without deviating therefrom. Therefore, the disclosed embodiments should not be limited to any single embodiment, but rather should be construed in breadth and scope in accordance with the appended claims.

FIGS. 10-11 shows a perspective view of automated reciprocating hair dryer 1000 having bowl 1004 oriented in a raised position. Base 1002 is configured to exhaust air. Bowl 1004 has top opening 1006 and bottom opening 1008. Bowl 1004 may be any shape including, but not limited to, cylindrical and/or cone shaped. Bowl 1004 may be tapered. Top opening 1006 of bowl 1004 has a larger diameter than the diameter of bottom opening 1008 of bowl 1004. Bowl 1004 has outer wall 1010 and inner wall 1012 forming chamber 1014 (FIGS. 12 and 12A). FIGS. 10, 11, and 12 show pipe 1020 having first end 1022 located opposite second end 1024. First end 1022 of pipe 1020 is connected to base 1002. Linear actuator 1026 has support frame 1028 with track 1030 and motor 1032.

FIGS. 10-11 show at least a portion of hose 1034 is collapsible. FIG. 10 shows linear actuator 1026 has bowl 1004 in a raised position and hose 1034 is stretched. FIG. 11 shows linear actuator 1026 has bowl 1004 in a lowered position and hose 1034 is retracted. Hose 1034 has first end 1036 and second end 1038. First end 1036 of hose 1034 is connected to blower 1040. Hose 1034 Second end 1038 of hose 1034 is connected to an end of protruding structure 1016 of bowl 1004. It is within the scope of this invention for bowl 1004 to also be known as a halo. Pipe 1020 is in alignment with top opening 1006 and bottom opening 1008 of bowl 1004. FIG. 12 best shows second end 1024 of pipe 1020 being configured to receive air 1200 (FIG. 12) discharged from chamber 1014 of bowl 1004. First end 1022 of pipe 1020 is configured to exhaust air 1200 into base 1002 (FIGS. 10, 11, and 12). Referring now to at least FIGS. 13-17, receiving structure 1302 is configured to support one or more and/or a multitude of bundles of hair using S Hook clips (not shown), where the hook of a S Hook clip hangs from the receiving structure and the clip of the S Hook is clipped to a bundle of hair, allowing the bundle of hair to be suspended from the receiving structure.

FIGS. 13-17 show automated reciprocating hair dryer 1000 having motor 1032 configured to drive linear actuator 1026 to reciprocate bowl 1004 from a raised position above pipe 1020 to a lower position around pipe 1020. Motor 1032 has a drive shaft in communication with a belt and pulley. The protruding structure has one or more components configured to carry a load or the bowl on the track of the linear actuator. Some of these components may include linear bearings and/or guides may include, but not be limited to a guide wheel, a bushing, and/or a v-track. Housing 1300 is connected to base 1002. It is within the scope of this invention for automated reciprocating hair dryer 1000 to have an operational display controller element (not shown) that is configured to be affixed on at least a portion of housing 1300 and/or the drying chamber. The operational display controller element may have a user interface configured for a user to operate automated reciprocating hair dryer 1000. Housing 1300 retains linear actuator 1026, bowl 1004, pipe 1020, and at least a portion of hose 1034 (FIGS. 10-11). FIGS. 15-16 best show base 1002 having first opening 1600A configured to connect pipe 1020 to base 1002. Base 1002 has second opening 1600B configured to receive hose 1034 (FIGS. 10-11).

FIGS. 13-17 show second end 1024 of pipe 1020 has receiving structure 1302. Receiving structure 1302 may be any shape such as radiused and/or dome shaped and may have one or more openings 1304. Receiving structure 1302 positions a wig cap, for example, in an upright orientation during drying, which is beneficial to the longevity and the integrity of the components of a wig cap and/or any other hair that may be dried in the system. The one or more openings 1304 are configured to facilitate a quicker drying process and a more evenly drying rate of at least a portion of hair 1042 (FIGS. 10 and 11) when the flow of air goes through the openings of the receiving structure 1302. Receiving structure 1302 is configured to support at least a portion of hair 1042 (FIGS. 10 and 11). It is within the scope of this invention for the positioning module to be configured to measure and/or detect at least the length of a hair piece that is loaded, clipped, in communication with, removably connected to, and/or hung on at least a portion of the pipe and/or the receiving structure of the pipe. In particular, the position module is configured to move the bowl a distance in correlation to the measured length of the hair piece. In an embodiment the bundles of hair may be clipped to the receiving unit. In another embodiment, a wig unit may be placed on the receiving unit for cap drying.

FIGS. 12 and 12A show chamber 1014 of bowl 1004 is located between outer wall 1010 and inner wall 1012. Bowl 1004 has protruding structure 1016 forming inlet opening 1018. Protruding structure 1016 of bowl 1004 forming a bend such as, a 90 degree elbow. In another aspect, the hose may connect directly to the bowl (not shown). Inlet opening 1018 is configured to receive air 1200 from blower 1040 and discharge air 1200 into chamber 1014 of bowl 1004. Bowl 1004 has one or more discharge openings 1202. One or more discharge openings 1202 are capable of discharging air 1200 from chamber 1014 of bowl 1004. It is within the scope of this invention for a discharge opening 1202 to traverse around inner wall 1012 of bowl 1004. At least a portion of second end 1024 of pipe 1020 is configured to be received by bottom opening 1008 of bowl 1004. Flange 1204 and/or an overhang may extend inwardly from top opening 1006 of inner wall 1012 of bowl 1004. In an embodiment, one or more discharge openings may be located through at least a portion and or the circumference of an inner wall of the bowl.

It is within the scope of this invention for a fitting (not shown) connected to the base. The fitting is configured for remote discharge of the air from the base to a location that is out of the building, for example, as the automated reciprocating hair dryer.

FIG. 18 shows a schematic block diagram illustrating an embodiment of circuitry 1900 of the dryer system having motor 1904 being connected to power source 1902. Motor 1904 is electrically connected to a positioning sensor 1906. Positioning sensor 1906 is configured to control the position of motor 1904. Computing device and/or control unit 1908 is electrically connected to positioning sensor 1906 of motor 1904. Computing device and/or control unit 1908 is electrically connected to power source 1902. The blower may have blower motor 1914 having a heating element. Thermal protection circuit having a temperature sensor 1910 is configured to interrupt power to and/or turn off heating element of blower 1912 when thermal protection circuit having a temperature sensor 1910 detects a temperature that exceeds a predetermined threshold value. For example, if the predetermined threshold value may be a temperature range indicative of a fire and/or safety hazard.

FIG. 19 shows a schematic block diagram illustrating an embodiment of circuitry 2000 of the dryer system having stepper motor 2004 being connected to power source 2002. Stepper motor 2004 has positioning module 2006. Positioning module 2006 is configured to control the position of stepper motor 2004. Computing device and/or control unit 2008 is electrically connected to positioning module 2006 of stepper motor 2004. It is within the scope of this invention for the positioning module to be configured to measure and/or detect at least the length of a hair piece that is loaded, clipped, in communication with, removably connected to, and/or hung on at least a portion of the pipe and/or the receiving structure of the pipe. In particular, the position module is configured to move the bowl a distance in correlation to the measured length of the hair piece. In an embodiment the bundles of hair may be clipped to the receiving unit. In another embodiment, a wig unit may be placed on the receiving unit for cap drying. Computing device and/or control unit 2008 is electrically connected to power source 2002. The blower may have blower motor 2014 having a heating element. Thermal protection circuit having a temperature sensor 2010 is configured to interrupt power to and/or turn off heating element of blower 2012 when thermal protection circuit having a temperature sensor 2010 detects a temperature that exceeds a predetermined threshold value. For example, if the predetermined threshold value may be a temperature range indicative of a fire and/or safety hazard.

Additional Description

A stepper motor, also known as step motor or stepping motor, includes, but is not limited to, a brushless DC electric motor that separates a full rotation into a plurality of equal portions. The position of the motor may be moved and held at one of these portions without any position sensor for feedback (an open-loop controller), as long as the motor is accurately sized to the application in respect to torque and/or speed.

In some aspects, the techniques described herein relate to a method of drying a pliant elongate ply having a handle end, including: engaging the handle end of the ply with a hanger; supporting the hanger above a drying chamber with a hanger perch; enclosing the drying chamber within a housing; defining an airflow volume; and, rotatably supporting the drying chamber with respect to the housing, such that the ply is supported vertically within the drying chamber and alternately supported at least one of in a path of a flow of drying air and under a centrifugal force within the drying chamber.

In some aspects, the techniques described herein relate to a method, and wherein the hanger perch is stationary relative to the housing, In some aspects, the techniques described herein relate to a method, and wherein the hanger perch is stationary relative to the drying chamber.

In some aspects, the techniques described herein relate to a method, and wherein the drying flow of air is projected radially and outward with respect to an axis of rotation of the drying chamber.

In some aspects, the techniques described herein relate to a method, wherein the centrifugal force is sufficiently large to express moisture from the ply and further including collecting the moisture from the drying chamber with at least one of a reservoir and exit conduit.

In some aspects, the techniques described herein relate to a method, wherein the housing includes a lid above the airflow volume that is configured to guide airflow with at least one of vanes and intake geometry, and further guiding a drying flow of air into the housing with the lid.

In some aspects, the techniques described herein relate to a method, and wherein the housing includes airflow control geometry configured to accelerate a drying flow of air into the drying chamber with a source of motivated airflow proximate a bottom of the housing.

In some aspects, the techniques described herein relate to a method, wherein the drying chamber includes a rotation axis and an interior wall, and wherein the hanger perch is configured to support the hanger at a radially-sweeping radius, the radially-sweeping radius being one that is offset from the rotation axis and inset from the interior wall, and further imposing the centrifugal force to the ply with the drying chamber to at least one of radially sweep the ply away from the rotation axis and/or, for a ply including a plurality of elongate strands, radially and/or angularly sweeps the strands away from one another.

In some aspects, the techniques described herein relate to a method, and further: selecting at least one of a duration and intensity of rotational motion, spin, and/or centrifugal force with a spin parameter controller, one selected from a list including a knob, a button, and/or a control panel/multi-mode interface.

In some aspects, the techniques described herein relate to a method, and further selecting at least one of a duration and an intensity of airflow through the airflow volume with an air flow parameter controller, one selected from a list including a knob, a button, and/or a control panel/multi-mode interface.

In some aspects, the techniques described herein relate to a device for drying a pliant elongate ply having a handle end, such as a weft of elongate and/or depending materials or hair/having a hem, including: a hanger configured to engage a weft, a hem, or the handle end; a hanger perch configured to support the hanger above a drying chamber; and a housing defining an airflow volume configured to enclose the drying chamber therein, wherein the drying chamber is rotatably supported within the housing, such that the device is configured to vertically support the ply within the drying chamber and be alternately supported at least one of in a path of a flow of drying air through and under a centrifugal force within the drying chamber.

In some aspects, the techniques described herein relate to a device, wherein the drying chamber includes a rotation axis and an interior wall, and wherein the hanger perch is configured to support the hanger at a radially-sweeping radius, the radially-sweeping radius being one that is offset from the rotation axis and inset from the interior wall, such that imposing the centrifugal force at least one of radially sweeps the ply away from the rotation axis and/or, for a ply including a plurality of elongate strands, radially and/or angularly sweeps the strands away from one another.

In some aspects, the techniques described herein relate to a device, wherein the perch is an annular lip at least one of proximate a top of the drying chamber and above the drying chamber.

In some aspects, the techniques described herein relate to a device, further including a base proximate a bottom of the airflow volume, the base including a motor configured to at least one of rotate the drying chamber, motivate airflow, and/or function as a source of airflow.

In some aspects, the techniques described herein relate to an automated reciprocating hair dryer, including: 2. a base, the base is configured to exhaust air; a bowl, the bowl having a top opening and a bottom opening, the bowl having an outer wall and an inner wall forming a chamber, the chamber is located between the outer wall and the inner wall, the bowl having a protruding structure forming an inlet opening; a pipe, the pipe having a first end located opposite a second end, the first end of the pipe is connected to the base; a linear actuator, including: a support frame, the support frame having a track; and, a motor, the motor is connected to a power source, the motor is electrically connected to a positioning sensor, the positioning sensor is configured to control the position of the motor, the motor is configured to drive the linear actuator to reciprocate the bowl from a raised position above the pipe to a lower position around the pipe; a hose, at least a portion of the hose is collapsible, the hose having a first end and a second end, a housing, the housing is connected to the base, the housing retaining the linear actuator the bowl, the pipe, and at least a portion of the hose; a computing device, the computing device is electrically connected to the positioning sensor of the motor, the computing device is electrically connected to the power source; and, a blower, the first end of the hose is connected to the blower, the second end of the hose is connected to the inlet opening of the protruding structure of the bowl, the inlet opening is configured to receive air from the blower and discharge the air into the chamber of the bowl, the bowl having one or more discharge openings, the one or more discharge openings are capable of discharging air from the chamber of the bowl, the pipe is in alignment with the top opening and the bottom opening of the bowl, at least a portion of the second end of the pipe is configured to be received by the bottom opening of the bowl, the second end of the pipe is configured to receive the air discharged from the chamber of the bowl, the first end of the pipe is configured to exhaust the air into the base.

In some aspects, the techniques described herein relate to an automated reciprocating hair dryer, wherein the blower has a heating element. Referring now to at least FIGS.

13-17, receiving structure 1302 is configured to support one or more and/or a multitude of bundles of hair using S Hook clips (not shown), where the hook of a S Hook clip hangs from the receiving structure and the clip of the S Hook is clipped to a bundle of hair, allowing the bundle of hair to be suspended from the receiving structure.

In some aspects, the techniques described herein relate to an automated reciprocating hair dryer, further including a thermal protection circuit having a temperature sensor, the thermal protection circuit configured to turn off the heating element when the temperature sensor detects a temperature that exceeds a predetermined threshold value.

In some aspects, the techniques described herein relate to an automated reciprocating hair dryer, wherein the second end of the pipe having a receiving structure, the receiving structure having one or more openings, the receiving structure configured to support at least a portion of hair.

In some aspects, the techniques described herein relate to an automated reciprocating hair dryer, wherein the protruding structure of the bowl forming a bend.

In some aspects, the techniques described herein relate to an automated reciprocating hair dryer, further including a fitting connected to the base, the fitting is configured for remote discharge of the air.

In some aspects, the techniques described herein relate to an automated reciprocating hair dryer, wherein the bowl is tapered, the top opening having a larger diameter than the diameter of the bottom opening.

In some aspects, the techniques described herein relate to an automated reciprocating hair dryer, including: a base, the base is configured to exhaust air; a bowl, the bowl having a top opening and a bottom opening, the bowl having an outer wall and an inner wall forming a chamber, the chamber is located between the outer wall and the inner wall, the bowl having a protruding structure forming an inlet opening; a pipe, the pipe having a first end located opposite a second end, the first end of the pipe is connected to the base; a linear actuator, including: a support frame, the support frame having a track; and, a stepper motor, the stepper motor is connected to a power source, the stepper motor having a positioning module, the positioning module is configured to control the position of the motor, the motor is configured to drive the linear actuator to reciprocate the bowl from a raised position above the pipe to a lower position around the pipe; a hose, at least a portion of the hose is collapsible, the hose having a first end and a second end, a housing, the housing is connected to the base, the housing retaining the linear actuator the bowl, the pipe, and at least a portion of the hose; a computing device, the computing device is electrically connected to the positioning module of the motor, the computing device is electrically connected to the power source; and, a blower, the first end of the hose is connected to the blower, the second end of the hose is connected to the inlet opening of the protruding structure of the bowl, the inlet opening is configured to receive air from the blower and discharge the air into the chamber of the bowl, the bowl having one or more discharge openings, the one or more discharge openings are capable of discharging air from the chamber of the bowl, the pipe is in alignment with the top opening and the bottom opening of the bowl, at least a portion of the second end of the pipe is configured to be received by the bottom opening of the bowl, the second end of the pipe is configured to receive the air discharged from the chamber of the bowl, the first end of the pipe is configured to exhaust the air into the base. It is within the scope of this invention for the positioning module to be configured to measure and/or detect at least the length of a hair piece that is loaded, clipped, in communication with, removably connected to, and/or hung on at least a portion of the pipe and/or the receiving structure of the pipe. In particular, the position module is configured to move the bowl a distance in correlation to the measured length of the hair piece. In an embodiment the bundles of hair may be clipped to the receiving unit. In another embodiment, a wig unit may be placed on the receiving unit for cap drying.

In some aspects, the techniques described herein relate to an automated reciprocating hair dryer, wherein the blower has a heating element.

In some aspects, the techniques described herein relate to an automated reciprocating hair dryer, further including a thermal protection circuit having a temperature sensor, the thermal protection circuit configured to turn off the heating element when the temperature sensor detects a temperature that exceeds a predetermined threshold value.

In some aspects, the techniques described herein relate to an automated reciprocating hair dryer, wherein the second end of the pipe having a receiving structure, the receiving structure having one or more openings, the receiving structure configured to support at least a portion of hair.

In some aspects, the techniques described herein relate to an automated reciprocating hair dryer, wherein the protruding structure of the bowl forming a bend.

In some aspects, the techniques described herein relate to an automated reciprocating hair dryer, further including a fitting connected to the base, the fitting is configured for remote discharge of the air.

In some aspects, the techniques described herein relate to an automated reciprocating hair dryer, wherein the bowl is tapered, the top opening having a larger diameter than the diameter of the bottom opening.

What is claimed:

1. An automated reciprocating hair dryer, comprising:

a base, the base is configured to exhaust air;

a bowl, the bowl having a top opening and a bottom opening, the bowl having an outer wall and an inner wall forming a chamber, the chamber is located between the outer wall and the inner wall, the bowl having a protruding structure forming an inlet opening;

a pipe, the pipe having a first end located opposite a second end, the first end of the pipe is connected to the base;

a linear actuator, comprising:

a support frame, the support frame having a track; and, a motor, the motor is connected to a power source, the motor is electrically connected to a positioning sensor, the positioning sensor is configured to control the position of the motor, the motor is configured to drive the linear actuator to reciprocate the bowl from a raised position above the pipe to a lower position around the pipe;

a hose, at least a portion of the hose is collapsible, the hose having a first end and a second end, a housing, the housing is connected to the base, the housing retaining the linear actuator the bowl, the pipe, and at least a portion of the hose;

a computing device, the computing device is electrically connected to the positioning sensor of the motor, the computing device is electrically connected to the power source; and, a blower, the first end of the hose is connected to the blower, the second end of the hose is connected to the inlet opening of the protruding structure of the bowl, the inlet opening is configured to receive air from the blower and discharge the air into the chamber of the bowl, the bowl having one or more discharge openings, the one or more discharge openings are capable of discharging air from the chamber of the bowl, the pipe is in alignment with the top opening and the bottom opening of the bowl, at least a portion of the second end of the pipe is configured to be received by the bottom opening of the bowl, the second end of the pipe is configured to receive the air discharged from the chamber of the bowl, the first end of the pipe is configured to exhaust the air into the base.

2. The automated reciprocating hair dryer of claim 1, wherein the blower has a heating element.

3. The automated reciprocating hair dryer of claim 2, further comprising a thermal protection circuit having a temperature sensor, the thermal protection circuit configured to turn off the heating element when the temperature sensor detects a temperature that exceeds a predetermined threshold value.

4. The automated reciprocating hair dryer of claim 1, wherein the second end of the pipe having a receiving structure, the receiving structure having one or more openings, the receiving structure configured to support at least a portion of hair.

5. The automated reciprocating hair dryer of claim 1, wherein the protruding structure of the bowl forming a bend.

6. The automated reciprocating hair dryer of claim 1, further comprising a fitting connected to the base, the fitting is configured for remote discharge of the air.

7. The automated reciprocating hair dryer of claim 1, wherein the bowl is tapered, the top opening having a larger diameter than the diameter of the bottom opening.

8. An automated reciprocating hair dryer, comprising:

a base, the base is configured to exhaust air;

a bowl, the bowl having a top opening and a bottom opening, the bowl having an outer wall and an inner wall forming a chamber, the chamber is located between the outer wall and the inner wall, the bowl having a protruding structure forming an inlet opening;

a pipe, the pipe having a first end located opposite a second end, the first end of the pipe is connected to the base;

a linear actuator, comprising:

a support frame, the support frame having a track; and, a stepper motor, the stepper motor is connected to a power source, the stepper motor having a positioning module, the positioning module is configured to control the position of the motor, the motor is configured to drive the linear actuator to reciprocate the bowl from a raised position above the pipe to a lower position around the pipe;

a hose, at least a portion of the hose is collapsible, the hose having a first end and a second end, a housing, the housing is connected to the base, the housing retaining the linear actuator the bowl, the pipe, and at least a portion of the hose;

a computing device, the computing device is electrically connected to the positioning module of the motor, the computing device is electrically connected to the power source; and, a blower, the first end of the hose is connected to the blower, the second end of the hose is connected to the inlet opening of the protruding structure of the bowl, the inlet opening is configured to receive air from the blower and discharge the air into the chamber of the bowl, the bowl having one or more discharge openings, the one or more discharge openings are capable of discharging air from the chamber of the bowl, the pipe is in alignment with the top opening and the bottom opening of the bowl, at least a portion of the second end of the pipe is configured to be received by the bottom opening of the bowl, the second end of the pipe is configured to receive the air discharged from the chamber of the bowl, the first end of the pipe is configured to exhaust the air into the base.

9. The automated reciprocating hair dryer of claim 8, wherein the blower has a heating element.

10. The automated reciprocating hair dryer of claim 9, further comprising a thermal protection circuit having a temperature sensor, the thermal protection circuit configured to turn off the heating element when the temperature sensor detects a temperature that exceeds a predetermined threshold value.

11. The automated reciprocating hair dryer of claim 8, wherein the second end of the pipe having a receiving structure, the receiving structure having one or more openings, the receiving structure configured to support at least a portion of hair.

12. The automated reciprocating hair dryer of claim 8, wherein the protruding structure of the bowl forming a bend.

13. The automated reciprocating hair dryer of claim 8, further comprising a fitting connected to the base, the fitting is configured for remote discharge of the air.

14. The automated reciprocating hair dryer of claim 8, wherein the bowl is tapered, the top opening having a larger diameter than the diameter of the bottom opening.

15. A method for drying at least a portion of removable hair, comprising the steps of:

providing an automated reciprocating hair dryer, the automated reciprocating hair dryer comprising, a base, the base is configured to exhaust air;

a bowl, the bowl having a top opening and a bottom opening, the bowl having an outer wall and an inner wall forming a chamber, the chamber is located between the outer wall and the inner wall, the bowl having a protruding structure forming an inlet opening;

a pipe, the pipe having a first end located opposite a second end, the first end of the pipe is connected to the base;

a linear actuator, comprising:

a support frame, the support frame having a track; and, a motor, the motor is connected to a power source, the motor is electrically connected to a positioning sensor, the positioning sensor is configured to control the position of the motor, the motor is configured to drive the linear actuator to reciprocate the bowl from a raised position above the pipe to a lower position around the pipe;

a hose, at least a portion of the hose is collapsible, the hose having a first end and a second end, a housing, the housing is connected to the base, the housing retaining the linear actuator the bowl, the pipe, and at least a portion of the hose;

a computing device, the computing device is electrically connected to the positioning sensor of the motor, the computing device is electrically connected to the power source; and, a blower, the first end of the hose is connected to the blower, the second end of the hose is connected to the inlet opening of the protruding structure of the bowl, the inlet opening is configured to receive air from the blower and discharge the air into the chamber of the bowl, the bowl having one or more discharge openings, the one or more discharge openings are capable of discharging air from the chamber of the bowl, the pipe is in alignment with the top opening and the bottom opening of the bowl, at least a portion of the second end of the pipe is configured to be received by the bottom opening of the bowl, the second end of the pipe is configured to receive the air discharged from the chamber of the bowl, the first end of the pipe is configured to exhaust the air into the base;

providing the at least a portion of removable hair;

placing the at least a portion of removable hair at the second end of the pipe when the bowl is raised in a position above the pipe;

lowering the bowl around at least a portion of the pipe and the at least a portion of removable hair; and discharging the air from the blower and out of the bowl to the at least a portion of removable hair when the blower is activated.

* * * * *